US010214967B2

(12) United States Patent
Alkhalaileh et al.

(10) Patent No.: US 10,214,967 B2
(45) Date of Patent: Feb. 26, 2019

(54) COMPOSITE POLYCRYSTALLINE DIAMOND BODY

(71) Applicant: International Diamond Services, Inc., Houston, TX (US)

(72) Inventors: Samer Alkhalaileh, Dublin, OH (US); David Briggs, The Woodlands, TX (US); Jiang Xiaole, Zhengzhou (CN); Zhao Yunliang, Zhengzhou (CN)

( * ) Notice: Subject to any disclaimer, the term of this patent is extended or adjusted under 35 U.S.C. 154(b) by 353 days.

(21) Appl. No.: 14/248,717

(22) Filed: Apr. 9, 2014

(65) Prior Publication Data

US 2014/0237906 A1 Aug. 28, 2014

Related U.S. Application Data

(63) Continuation of application No. 13/072,203, filed on Mar. 25, 2011.

(51) Int. Cl.

| | |
|---|---|
| ***B22F 5/00*** | (2006.01) |
| ***B22F 5/10*** | (2006.01) |
| ***B22F 7/06*** | (2006.01) |
| ***C22C 26/00*** | (2006.01) |
| ***E21B 10/567*** | (2006.01) |
| ***E21B 10/573*** | (2006.01) |
| ***B24D 3/06*** | (2006.01) |
| ***B24D 18/00*** | (2006.01) |

(52) U.S. Cl.

CPC ..... *E21B 10/5676* (2013.01); *B22F 7/062* (2013.01); *B24D 3/06* (2013.01); *B24D 18/0009* (2013.01); *C22C 26/00* (2013.01); *E21B 10/5735* (2013.01); *B22F 2005/001* (2013.01); *B22F 2999/00* (2013.01)

(58) Field of Classification Search

CPC .. E21B 10/5676; E21B 10/5735; B22F 7/062; B24D 3/06; B24D 18/0009; C22C 26/00

See application file for complete search history.

(56) References Cited

U.S. PATENT DOCUMENTS

| | | | | |
|---|---|---|---|---|
| 4,604,106 | A | 8/1986 | Hall | |
| 5,469,927 | A * | 11/1995 | Griffin | E21B 10/5735 175/432 |
| 5,645,617 | A | 7/1997 | Frushour | |
| 6,187,068 | B1 | 2/2001 | Frushour | |
| 6,408,959 | B2 | 6/2002 | Bertagnolli | |
| 7,070,635 | B2 | 7/2006 | Frushour | |
| 7,517,588 | B2 | 4/2009 | Frushour | |
| 7,595,110 | B2 | 9/2009 | Frushour | |
| 2011/0031033 | A1 * | 2/2011 | Mourik | C22C 26/00 175/428 |

FOREIGN PATENT DOCUMENTS

| | | | |
|---|---|---|---|
| WO | WO 2009/125355 | * 10/2009 | B22F 7/06 |
| WO | WO 2009/147629 | * 12/2009 | B01J 3/06 |

* cited by examiner

*Primary Examiner* — Pegah Parvini

(74) *Attorney, Agent, or Firm* — Taylor Intellectual PLLC; James W. Taylor, II

(57) ABSTRACT

In this novel PDC cutter, diamond powders of different composition and/or different grain size, are distributed, shaped, and compacted with a novel pressing tool, in multiple stages, spatially arranged into different regions of the PDC diamond body, then HPHT sintered to form one PDC body with spatially varying hardness, toughness and thermal resistance.

5 Claims, 21 Drawing Sheets

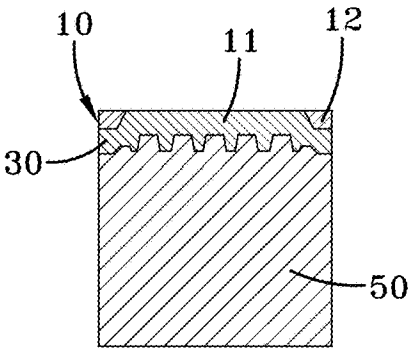
FIG-12
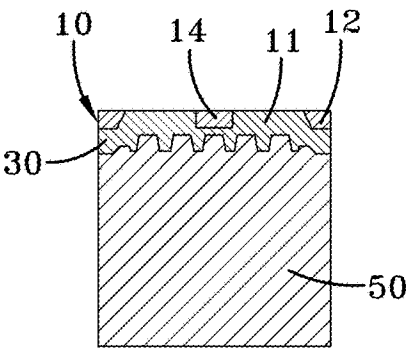
FIG-13
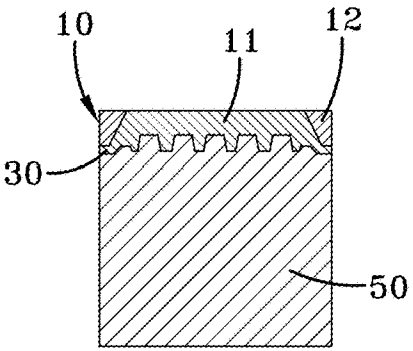
FIG-14
FIG-15
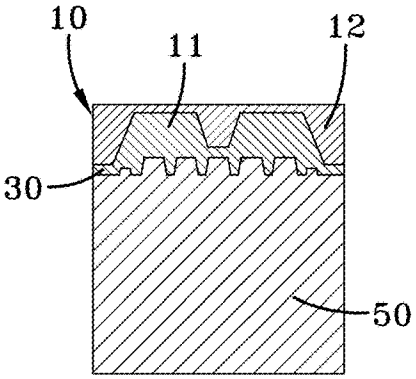
FIG-16
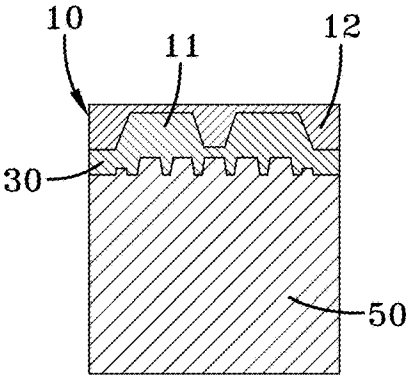
FIG-17
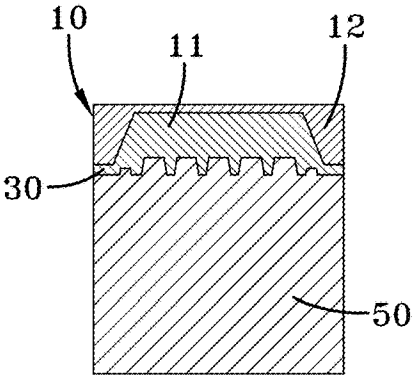
FIG-18
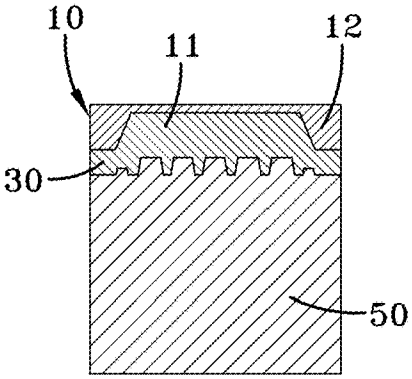
FIG-19

| Element | Wt. Pct. | At. Pct. |
|---|---|---|
| C | 0.19 | 2.06 |
| Co | 16.64 | 37.64 |
| W | 83.17 | 60.30 |
| Total | 100.00 | |

COMPOSITE POLYCRYSTALLINE DIAMOND BODY

CROSS-REFERENCE TO RELATED APPLICATIONS

This application is a continuation of, and claims the benefit of priority from, U.S. Ser. No. 13/072,203, filed on 25 Mar. 2011, which is incorporated by reference as if fully recited herein.

INVENTIVE FIELD

Exemplary embodiments are directed to a body for use in cutting, machining, drilling and similar operations, and a method of manufacture of the body. More particularly, exemplary embodiments are directed to a composite polycrystalline diamond body and method of manufacture that may be used for cutting, machining, drilling and other similar operations.

BACKGROUND

As used in the following disclosure and claims, the term polycrystalline diamond (PCD) is intended to refer to the type of material that is made by subjecting diamond crystals to a high temperature and pressure that results in intercrystalline bonding of the individual diamond crystal. In exemplary embodiments, the intercrystalline bonding is usually facilitated by use of a specific catalyst family of transition metals, usually as molten fluid. Although catalysts greatly aid the sinter bonding of PCD, it is frequently the case that catalyst is left over in the PCD material. This is especially true for diamond granular materials that are difficult to contact with molten metals, such as fine particle size and/or highly textured diamond. The presence of residual catalyst in the PCD generally changes its quality and compels design compromise between various desirable and undesirable properties of a cutting material. PCD is not diamond; it is a composite of varying composition comprising hard diamond and soft catalyst metal.

In many different applications, PCD has displayed advantages over the use of a single crystal diamond. Typically, a single crystal diamond has a much lower impact resistance than PCD, due to the much higher modulus of elasticity of a single crystal compared to PCD. Furthermore, the specific planes of cleavage of a single crystal may allow relatively low forces to cause fracturing of the crystal. However, PCD may alleviate the problems caused by the planes of cleavage of a single crystal because the PCD is made up of randomly oriented individual crystals.

In some cases, PCD have been used for many years in drilling and machining. In the drilling industry the Polycrystalline Diamond Composite products are typically brazed to the drill bits is referred to as PDC. Therefore, from this point on when referring to Polycrystalline Diamond Composite used in the drilling industry, PDC is the abbreviation that will be used and it means the same thing as PCD.

Known PDCs have drawbacks that lead to the degradation wherein the PDC is unable to cut rock or stone. One of the factors limiting the success of the PDC is that larger crystals that may be used to form the PDC, while easy to sinter completely with low residual catalyst, typically produce fewer diamond-to-diamond bonds per unit volume. Fewer diamond-to-diamond bonds per unit volume may mean a weaker PDC. However, the lower residual catalyst content improves thermal resistance of PDC. Residual catalyst metal expands far more than sintered diamond and tends to weaken the PDC. Friction heat in all machining can be very high regardless of many methods used to mitigate it. Thus, larger grain size PDC has a tendency to fracture and abrade more easily than PDC comprising a multitude of smaller crystals but is more capable of withstanding heat.

On the contrary smaller crystals can generate more diamond-to-diamond intergranular bonds per unit volume but are more difficult to sinter completely to low residual catalyst metal content. Thus, finer grain size PCD tends to have higher hardness and strength but also higher residual catalyst content. Higher residual catalyst lowers density of diamond-to-diamond bonds, catalyst taking the space diamond would otherwise, but more importantly lowers the heat tolerance of PDC.

The result is a range of grades of PDC representing the compromise of hardness and heat resistance achieved by coarse and fine grains, with varying residual catalyst content, which perform non-optimally. Hard PDC is more sensitive to heat; heat-tolerant PDC is soft.

The different regions of the cutter perform different functions and optimally need not be the same material. In some embodiments, the rake may resist thermal spalling, chipping and adhesion wear, and be hard to resist abrasion of loose rock debris sliding over it. In exemplary embodiments, the flank may be very hard to grind the hard rock surface. The edge should be strong and hard. Therefore, it may be advantageous to use a multitude of smaller crystals in areas that need enhanced abrasion resistance, larger crystals in areas to enhance higher thermal resistance and/or different compositions of PDC to better handle the overall cutting function.

PDC have been used for industrial applications including rock drilling and metal machining for many years. PDC is normally bonded to a substrate, typically sintered tungsten carbide, to make shaping of the cutter and attachment of the cutter to a tool, such as a drill, easier. PDC is very difficult to machine and attach to common drill materials, like steel or infiltrated carbide-metal. Sintered tungsten carbide is easy to machine and attach to metal drill bodies and toolholders, via for example, brazing.

Of course one of the factors limiting the success of PDC is the strength of the bond between the polycrystalline diamond layer and the cemented tungsten carbide substrate. For example, analyses of the failure mode for drill bits used for deep hole rock drilling show that in approximately thirty-three percent of the cases, bit failure or wear is caused by delamination of the diamond from the metal carbide substrate.

Furthermore, when cemented carbide mass is relied on to increase the impact resistance of PDC, the diamond layer is preferably relatively thin so that the diamond behaves as a supported layer, rather than monolithically. This restriction on the thickness of the diamond layer limits both the life expectancy of the composite body in use as well as the designs for PDC diamond tools.

Yet another problem that has limited the thickness of the diamond layer in composite bodies is caused by the problem of "bridging". Bridging refers to the phenomenon that occurs when a fine powder (especially a mono-modal powder) is pressed from multiple directions. It is observed that the individual particles in a powder being pressed tend to stack up and form arches or "bridges" that block the full amount of pressure so that the pressure often does not reach the center of the powder being pressed. This results in high porosity which requires more catalyst and thus tends to leave more residual catalyst in the sintered PDC.

In any type of PDC, there are two countering principals that are opposed to one another. For optimal abrasion resistance, very fine crystals of the abrasive material are used. The fine abrasive materials are sintered under high pressure and result in a higher density compact with more diamond-to-diamond bonds than coarser material in the PDC. However, as a result of the high density, the abrasive mass of very fine crystals presents increased resistance to the catalyst metal or catalyst metal and carbide from sweeping through the crystal interstices as well as increased packing defects due to bridging. The increased resistance may lead to soft spots of non- or weakly bonded abrasive material in the PDC.

However, coarser and/or larger abrasive crystals may provide larger channels and spaces in the compacted mass that may allow the catalyst metal to sweep through. Additionally, coarser and/or larger abrasive crystals may provide larger impact resistance when compared to smaller crystals, due to the higher content of catalyst metal. On the other hand, coarser materials may not provide the abrasion resistance that may be desired for a PDC material since they do not produce high diamond-to-diamond bonds per unit volume of PDC.

While grain and packing artifacts affect the quality of the PDC sintered mass, it also affects the quality of the bond of the PDC to the substrate. That bond is made by filaments of metal intermingled between sintered tungsten carbide and the PDC body. The higher the number per unit area of metal filaments penetrating both PDC and substrate, the better the bond. This is typically optimized by fine diamond grains adjacent to the substrate. Nonetheless, the issues of pressure and compaction affect this region of PDC perhaps more so than the PDC body.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein:

FIG. 12 is a cross-sectional side elevation view of an exemplary PDC body;

FIG. 13 is a cross-sectional side elevation view of an exemplary PDC body;

FIG. 14 is a cross-sectional side elevation view of an exemplary PDC body;

FIG. 16 is a cross-sectional side elevation view of an exemplary PDC body;

FIG. 17 is a cross-sectional side elevation view of an exemplary PDC body;

FIG. 18 is a cross-sectional side elevation view of an exemplary PDC body;

FIG. 19 is a cross-sectional side elevation view of an exemplary PDC body;

DETAILED DESCRIPTION OF EXEMPLARY EMBODIMENT(S)

Figure 1:
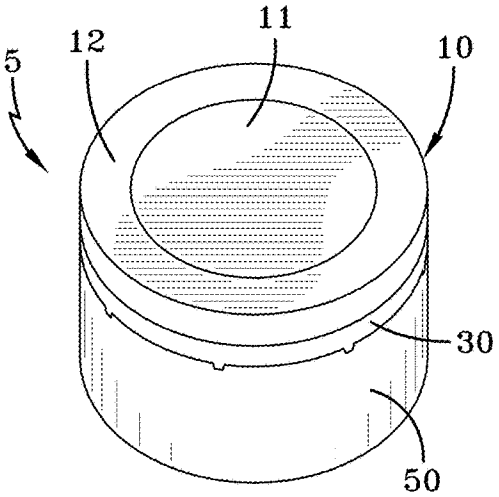
FIG. 1 is a perspective view of an exemplary PDC body.
Figure 2:
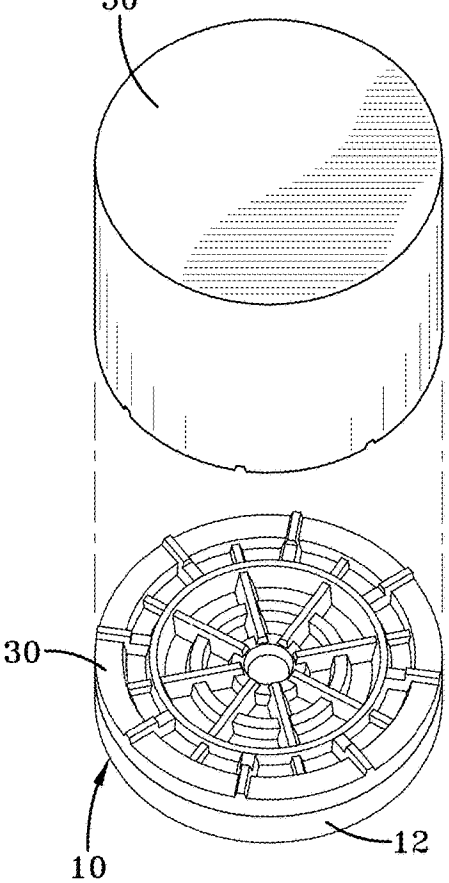
FIG. 2 is an exploded perspective view of the exemplary PDC body of FIG. 1.
Figure 3:
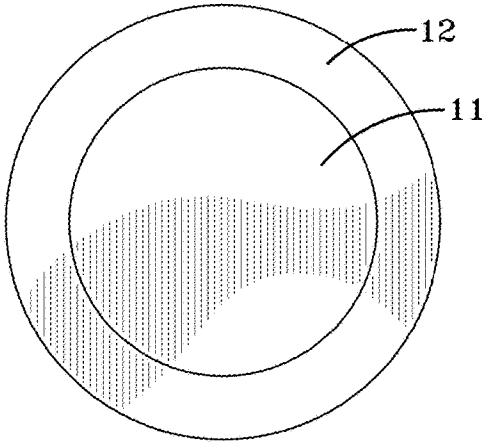
FIG. 3 is a top plan view of the PDC body of FIGS. 1-2.
Figure 4:
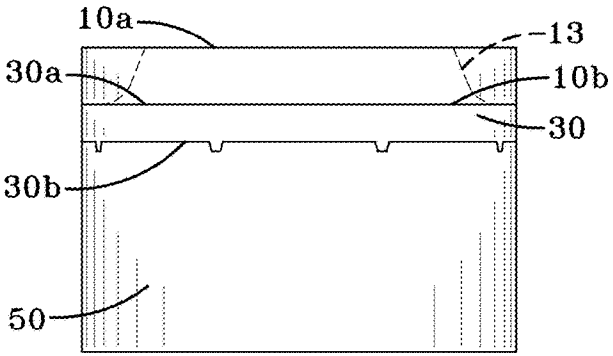
FIG. 4 is side elevation view of an exemplary PDC body.
Figure 5:
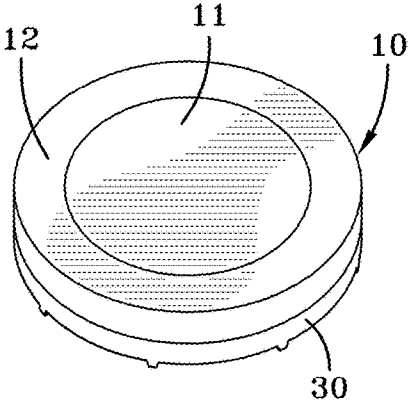
FIG. 5 is a top perspective view of an exemplary embodiment of a first portion and base portion of a PDC body.
Figure 7:
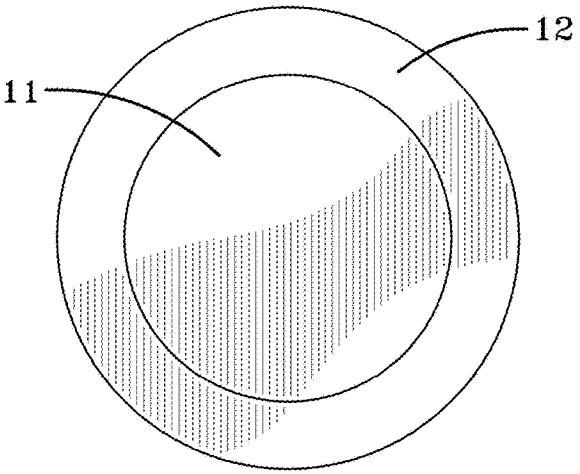
FIG. 7 is a top plan view of an exemplary PDC body.

As seen in FIG. 1, an exemplary embodiment of a PDC body 5 is depicted. In this exemplary embodiment, the PDC body 5 may include a first portion 10 and a base portion 30. In exemplary embodiments, the first portion 10 and the base portion 30 may be fabricated from crystalline diamond particles. In the embodiment found in FIG. 1, the crystalline diamond particles of at least a fraction of the first portion 10 are smaller than the particles found in the base portion 30.

In the example found in FIG. 1, the first portion 10 may include an inner concentric area 11 and an outer concentric area 12. The inner concentric area 11 may be comprised of diamond particles that are coarser in size compared to the diamond particles that comprise the outer concentric area. In some examples, the outer concentric area 12 is substantially the geometry of an annular ring, wherein the thickness of the ring is substantially the same along the length of the first portion 10, from a first end 10*a* to a second end 10*b*. Exemplary embodiments of the first portion 10 include a variety of diamond particle sizes to realize the benefits of a smaller diamond particle in certain areas of the body and the benefits of a coarser diamond particle in other areas thereof.

Figure 11:
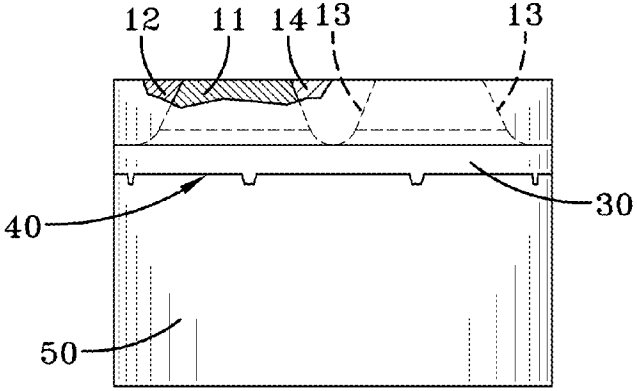
FIG. 11 is a side elevation view of an exemplary PDC body.

However, in other embodiments, as depicted in the cross-sectional profile of FIGS. 11-19, the thickness of the ring may change along from the first end to the second end. In some examples, the thickness may taper from the first end to the second end. However, in other examples, the thickness may have a profile that is at least a portion rounded or curved along its length 13, as depicted in FIG. 11. The taper or rounded profile may improve the stress distribution at the fine/coarse diamond interface and may improve attachment between the coarse and fine diamond regions.

One of the factors affecting the flow of molten (liquid) cobalt is the temperature distribution within the cup. The cup will get hottest at its walls (sides) and at the top (especially close to the outside diameter where the fine diamond layer is located). Higher temperature provides more energy to the molten metal, therefore, more metal flow takes place at hotter zones, having finer diamond at these locations (which in turn presents more resistance to molten catalyst flow) will help balance the flow of the molten metal in the whole cell. The rest of the PDC body has coarser diamond which presents less resistance to the molten catalyst flow, and in turn, an overall balanced molten catalyst flow and better sinter quality throughout the PDC body.

The thickness of the first portion 10 from the first end 10*a* to the second end 10*b* may depend on the size and desired characteristics of the PDC body 5. In one example, the thickness may be approximately 0.069 inches (1.75 mm). Additionally, although any number of sizes of inner concentric areas 11 and outer concentric areas 12 may be used, in one example, the inner concentric area has a diameter of approximately 0.375 inches (9.53 mm) and the outer concentric area 12 has a width of approximately 0.077 inches (1.96 mm), which produces an approximate total body diameter of 0.53 inches (13.46 mm). Furthermore, in other exemplary embodiments, any number of concentric areas may be used, and may include as many different sizes of diamond particles, as desired. An important feature is the profile of concentric area or ring may not be square. It may be radiused or tapered (ie. the area narrows the further it is from the top of the diamond table). In another example, the area may narrow when traveling from the second end 10*b* to the first end 10*a*, as shown in at least FIG. 11. Both the radius and/or taper may allow for the transformation from one diamond type and/or size to another to be more continuous and less step-wise. This may be defined as a functional gradient transformation. This was shown to have a substantial effect on the performance of exemplary PDCs. There was seen improved impact resistance with such diamond area profile compared to the square profile.

Any number of tapers and/or radiuses may be used in exemplary embodiments. A range of different tapers was tested, specifically 8° to 45° tapers off of vertical. Although this range was tested, tapers of other amounts may be used in exemplary embodiment. After processing the parts under high pressure and high temperature, the larger tapers closer to 45° produces a part with a triangular cross sectioned profile body, with almost a straight interface separating the coarse grained from the fine grained diamond. The impact resistance of such resulting product was lower for larger tapered profiles. As for the smaller tapers, the results were not significantly different from the non-tapered (square) profile. The best results were obtained when the taper was around 20°±5°, although other tapers ranges produced superior results from non-tapered profiles. When the radiused profile is used, the resulting product demonstrated comparable performance results to the exemplary taper-profiled products. In some examples, some of the typical PDC body diameters that may be used are 8 mm or 0.315", 9 mm or 0.354", 13 mm or 0.512", 16 mm or 0.630", 19 or 0.748" and 22 mm or 0.866".

In exemplary embodiments, the finer diamond particles may be between the sizes of 1 to 30 micron in diameter. However, coarser diamond might be used as long as the diamond in the core and the rest of the PDC body is coarser. The coarser diamond particles are preferably between the sizes of 12 to 100 micron in diameter as long as the coarser diamond particles in one region are larger than the finer diamond in the other regions. Size refers to average or mean sizes. The closer the mean sizes are in the two regions, the easier it is to make a PDC body substantially free of defects. The farther apart the mean sizes are the more critical compaction and fill quality (density distribution) are to the formation of the PDC body. When the size ratio is more than 1½ times coarse to fine, sintering quality of the fine diamond is adversely affected. The addition (blending) of Cobalt powder to assist in the Cobalt sweep may be desired. This is further discussed in one of the examples mentioned later.

Figure 10:
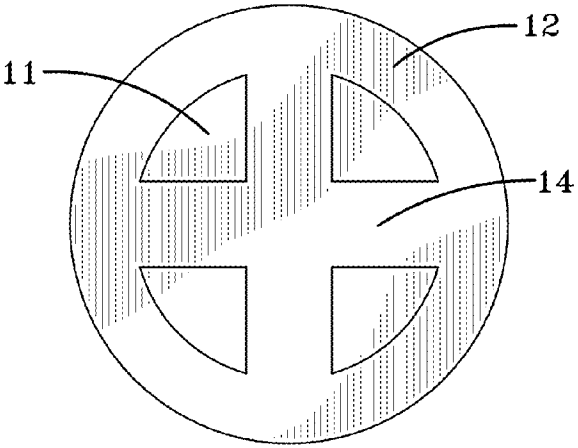
FIG. 10 is a top plan view of an exemplary PDC body.
Figure 9:
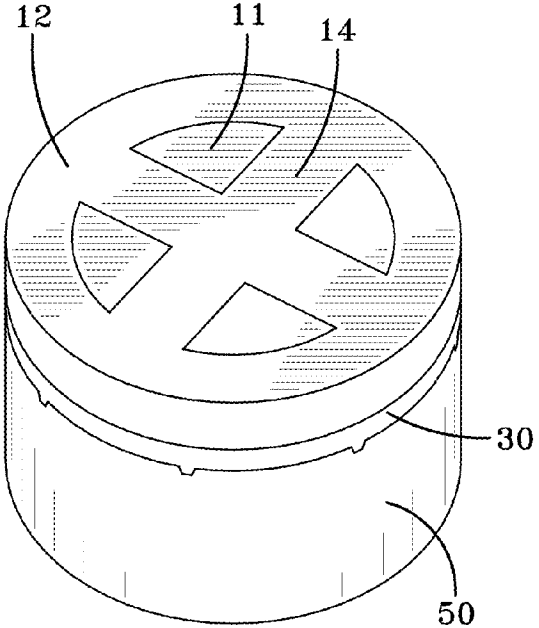
FIG. 9 is a perspective view of an exemplary PDC body.
Figure 21:
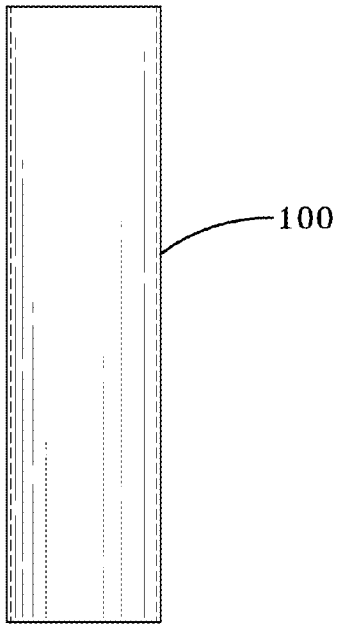
FIG. 21 is a side elevation view of an exemplary tube.
Figure 22:
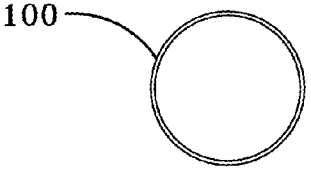
FIG. 22 is a top plan view of an exemplary tube.
Figure 20:
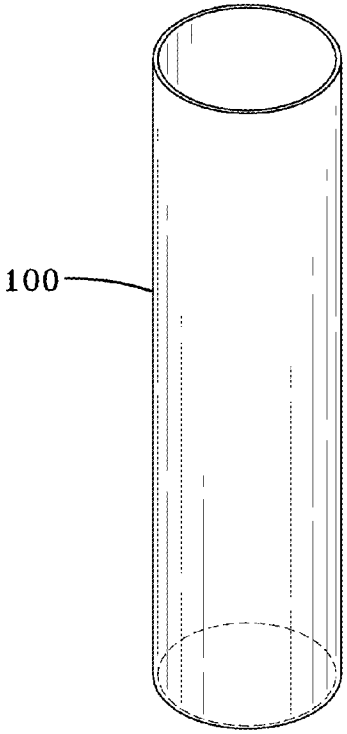
FIG. 20 is a perspective view of an exemplary tube.

In another example, the first portion 10 may include one or more segments 14 of finer diamond particles that may cross a portion of the inner concentric circle 11. As depicted in FIGS. 9-11, the one or more segments may cross the inner concentric circle 11 and segment the circle in substantially similar portions. However, in other embodiments, the one or more segments 14 may cross the inner concentric circle at any number of angles and form any number of chords across thereof.

It should be recognized that not all parts of a PDC cutter do the same job in the process of cutting rock and stone. The rake or top surface of the cutter, far from the edge is primarily responsible for moving cut debris away from the edge and flank so that the edge does not get packed with debris. The rake does not cut hard rock. Instead it must resist friction heating and tolerate friction heat, abrasion from hard rock debris (hard grits) shear flow, thermal adhesion wear, thermal cracking and thermal chipping.

The orthogonal side or flank of the cutter, far from the edge, is primarily responsible for abrading the hard rock or stone to generate the cut surface of the hole or edge. Typically, the flank sees less friction heat than the rake, and therefore it may need to be abrasion resistant.

The corner or edge of the cutter may need to have high bend strength to handle the high bend force of hard rock or stone pushing on it. It may also need to be abrasion resistant to compress and fracture the integral hard rock that causes cracks to propagate and proliferate and generates loose debris that is pushed over the rake surface and away (captured by cutting fluid and pumped out of the hole). To minimize the bend stress the edge is frequently chamfered on exemplary embodiments. This directs the force into the cutter body to maximize cutter bearing area and minimize the bending moment on the edge. Nonetheless, the edge must be hard to resist the abrasion of hard rock and strong to resist forces. Typically, thermal resistance is not a prime issue at the edge.

Figure 8:
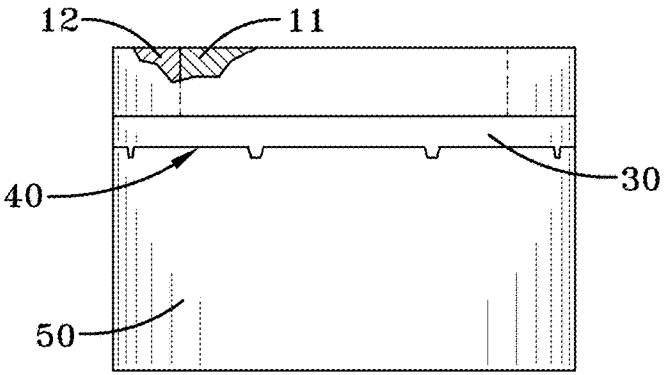
FIG. 8 is a side elevation view of an exemplary PDC body.
Figure 6:
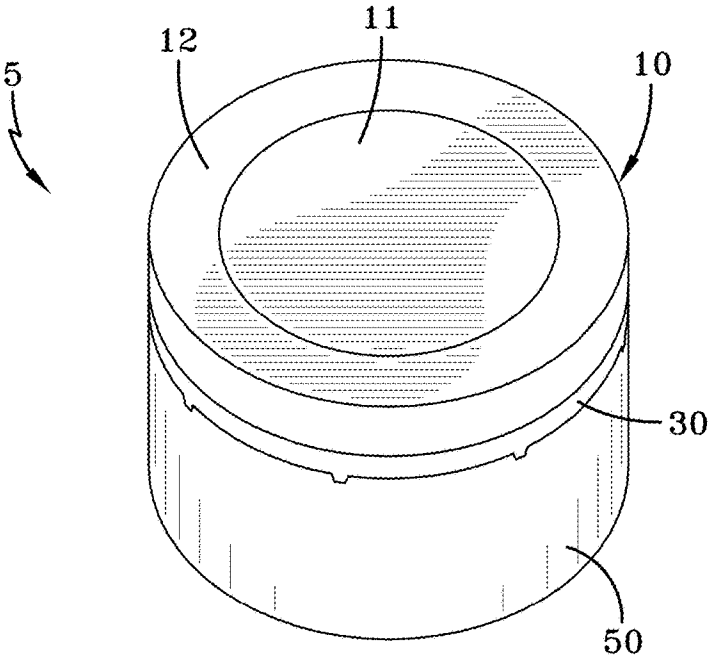
FIG. 6 is a perspective view of an exemplary PDC body.

Exemplary embodiments of the PDC body 5 may further include the base portion 30 that is disposed between the first portion 10 and a substrate 50. The base portion has first end 30*a* that engages the second end 10*b* of the first portion and a second end 30*b* that engages the substrate 50 at an intersecting surface 40, as seen in at least FIGS. 8 and 11. In exemplary embodiments, the base portion 30 may include coarser diamond particles of approximately the same size of the inner concentric circle 11 of the first portion, wherein the base portion diamond particles are a continuation of the inner concentric circle diamond particles. However, in other examples, the base portion 30 may include diamond particles that are larger or finer in size than the diamond particles included in the inner concentric circle 11.

The substrate 50 may include any interface shape, comprising arrangements of raised surfaces, slots, and/or roughness of any pattern random or deterministic, that can be used to support the article without delamination, cracking, or yielding. Any substrate suitable for conventional PDC cutters or in the prior art is appropriate with the novel diamond table In the embodiment depicted in FIG. 1, the PDC body 5 is substantially cylindrical in geometry. Although the PDC body 5 may be any number of geometries and sizes, an example PDC body 5 has an approximate diameter of 0.53 inches (13.46 mm). The approximate length of these products may vary, but some examples of typical lengths are 0.315" (8 mm), 0.512" (13 mm), 0.630" (16 mm), 0.748" (19 mm). However, in some embodiments, depending upon design characteristics of the PDC body many have there are some other lengths like 1.1417" (29 mm).

Exemplary embodiments of the PDC body dimensions are within practical limits for HPHT sintering, preferably in the range of 0.039" to 0.2" thick (1 to 5 mm thick), and 0.24" to 2.56" diameter (6 to 65 mm diameter).

Typically, but not necessarily, finished geometric details for PDC body are within practical limits for cutters and tools. Chamfer lengths and chamfer angles, hones, radii, chip-breaking features and any other normal dimensional features of PDC and PCD tool materials are included without limit.

Exemplary embodiments of the PDC bodies may be manufactured by any number of techniques. However, the preferred method is a powder distribution, shaping (for e.g., leveling, tapers, radii) and compacting device, as seen in at least FIGS. 20-36, comprising a tube 100 in conjunction with a bushing 110 and a cup 120. The diamond powders are loaded by conventional powder conveyance methods, distributed into discrete volumes with the PDC body 5, shaped and compacted within each volume separately or in one mass, into the cup 120 using the novel press device described. The substrate 50 may then be placed and/or pressed on top of and/or placed in intimate contact with, the arranged and compacted, diamond powder(s).

Compaction of diamond powder is essential to put the different regions of the PDC body in intimate contact such that catalyst metal does not accumulate to fill gaps, fissures, voids and/or holes between poorly compacted regions. The accumulation may impair bonding between the different regions of the PDC cutter.

Since the regions of the PDC cutter have different thicknesses and shapes, comprising different diamond grain sizes and/or diamond compositions, optimal compaction requires careful consideration. This is also true about the specific region in contact with the substrate. Thus a large portion of following discussion is related to methods of distributing, shaping, and compacting the different regions of the PDC diamond table and cutter prior to HPHT sintering.

Although any number of cups may be used, depending upon the desired geometry and size of PDC body to be manufactured, in one example, the cup 120 may be a cylinder with a first end 121 open and a second end 122 closed. In exemplary embodiments, the cup 120 may be manufactured from refractory metals including tantalum, molybdenum, niobium, zirconium and alloys thereof, any metal with melting point >1800 C that does not react with carbon or cobalt.

Any number of cylindrical tubes may be used, depending upon the desired geometry and size of PDC body to be manufactured. In one example, the tube 100 may be an elongated cylinder with a length of approximately 1.5 inches (38.1 mm), an outside diameter of approximately ⅜ inches, and a wall thickness of approximately 0.01 inches (0.25 mm). Although this embodiment is substantially tubular along the entire length of the tube, other embodiments of the tube 100 may include apertures or other recessed portions to impart different cross-sectional areas in the PDC body, as desired. In this embodiment, the tube 100 is manufactured from steel or any other material capable of supporting the compaction pressure without substantial deformation.

Figure 29:
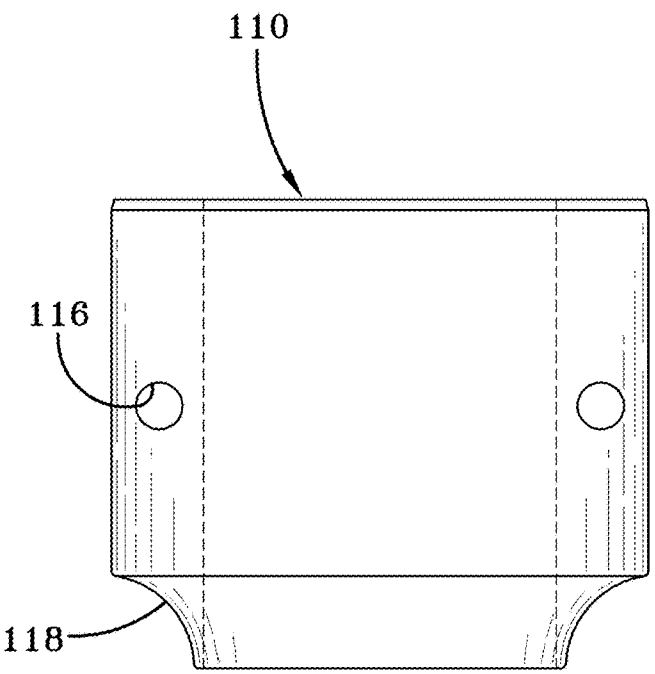
FIG. 29 is a side elevation view of an exemplary bushing.
Figure 28:
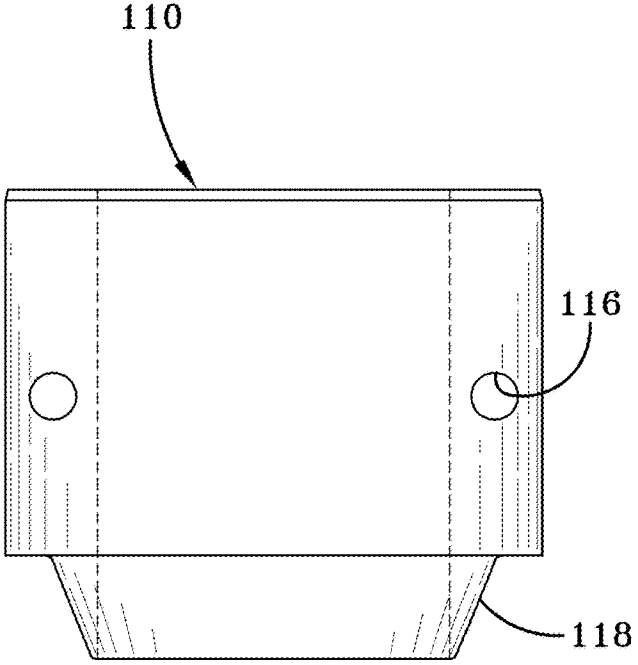
FIG. 28 is a side elevation view of an exemplary busing.

Although any number of bushings 110 may be used, depending upon the desired geometry and size of PDC body to be manufactured, in one example, the bushing 110 may be a two-piece plain bearing with a first and second shell 111 and 112. In one example, depicted in FIGS. 23-29, the first and second shells 111 and 112 are engaged by the use of one or more dowel pins 113. However, in other examples, other engagement means may be used to connect the shells. In one exemplary embodiment, the first and second shells 111 and 112 are substantially mirror images of one another. In this example, when the first and second shells 111 and 112 are engaged, the resulting body has an inner diameter of approximately 0.376 inches (9.55 mm), a wall thickness of approximately 0.099 inches (2.51 mm), and a length of approximately 0.5 inches (12.7 mm). In some examples, as seen in FIGS. 28 and 29, the first and/or second shells 111 and 112 may include a tapered or radiused profile to impart the complementary radiused and/or tapered profile of exemplary PDC bodies. The tapered and/or radiused profile may have any number of dimensions and/or sizes depending upon the desired taper and/or radius desired for the between the finer/coarser diamond interface 13.

Furthermore, exemplary embodiments of the first and second shells 111 and 112 may include a chamfer 114 on at least a portion of an outside edge to help facilitate the engagement of the bushing 110 within the cup 120. In one example, as depicted in FIG. 23, the chamfer 114 may be located at a 15 degree angle inward from the outside periphery of the bushing 110, at a length of approximately 0.011 inches (0.28 mm).

Figure 26:
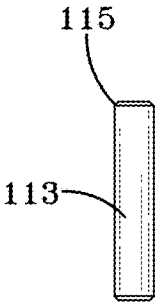
FIG. 26 is a front elevation view of an exemplary dowel pin.
Figure 27:
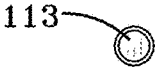
FIG. 27 is a top plan view of an exemplary dowel pin.
Figure 25:
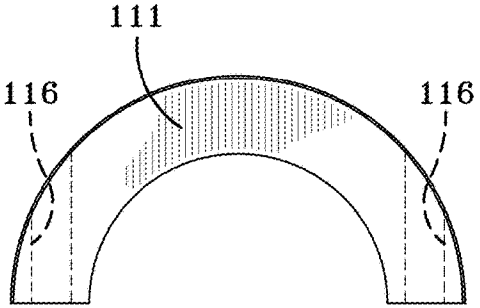
FIG. 25 is a top plan view of an exemplary shell of a bushing.

In exemplary embodiments, one or more dowel pins 113 may be used to facilitate the engagement of the one or more shells of the bushing. In one example, as depicted in FIGS. 25 and 26, two dowel pins 113 are used. In this example, the dowel pins are substantially cylindrical in shape, with a length of approximately 0.250 inches (6.35 mm) and an outside diameter of 0.049 inches (12.45 mm). The dowel pins may include a chamfer 115 located on at least a portion of an outside edge thereof to facilitate the engagement of the dowel pin 113.

In this embodiment, the shells are manufactured from cold rolled steel or any material capable of supporting the compaction pressure without deformation. In this embodiment, the dowel pins are manufactured from common steel although in general any rigid and strong material will work.

Figure 24:
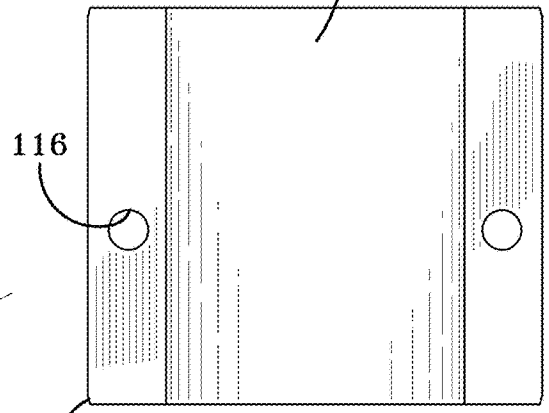
FIG. 24 is a side elevated view of an exemplary shell of a bushing
Figure 23:
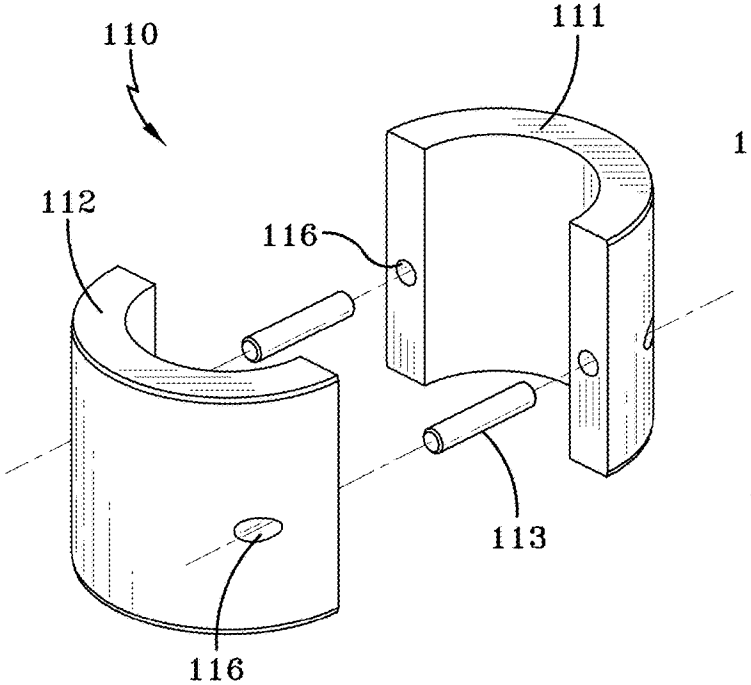
FIG. 23 is an exploded perspective view of an exemplary bushing within dowel pins.

The bushing 110 may include one or more apertures 116 within the one or more shells, as depicted in at least FIGS. 23-25. The one or more apertures 116 may run through the body of the one or more corresponding shells so that the apertures align and are adapted to receive an exemplary dowel pin 113. In one example, the aperture 116 of one shell may be adapted for a press fit with a dowel pin, while the corresponding aperture of the second shell may be adapted for a slip fit with the same pin. In one example, with a dowel pin having an outside diameter of 0.049 inches (12.45 mm), the aperture of the first shell may have a diameter of 0.050 inches (12.7 mm), while the aperture of the second shell has a diameter of 0.051 inches (12.95 mm).

Figure 32:
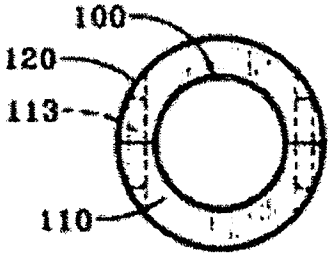
FIG. 32 is a top plan view of an assembly of an exemplary tube, bushing and cup.
Figure 31:
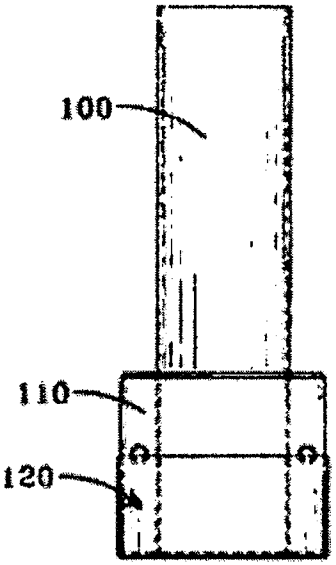
FIG. 31 is a side elevation view of an assembly of an exemplary tube, bushing and cup.
Figure 30:
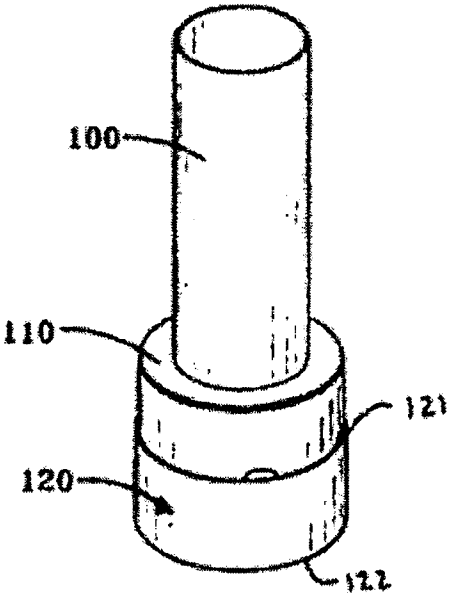
FIG. 30 is a perspective view of an assembly of an exemplary tube, bushing and cup.

During manufacture of an exemplary embodiment of a PDC body 5, the first step is to assemble the bushing 110 by engaging the first and second shells 111 and 112 together by the use of the corresponding dowel pins 113, as depicted in FIG. 23. After the bushing is assembled, the bushing may be inserted into the open end of the cup so that one end of the bushing engages the inner face of the closed end of the cup. Next, an exemplary tube may be inserted within the interior cavity of the bushing until inserted end of the tube engages at least a portion of the inner face of the closed end of the cup, as depicted in FIGS. 30-32.

Figure 34:
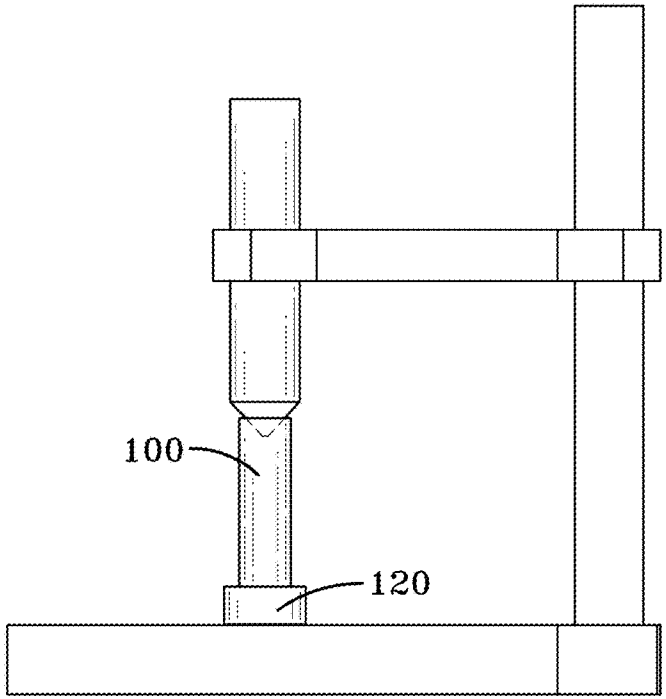
FIG. 34 is a side elevation view of an assembly placed within a press brake with the bushing removed.
Figure 33:
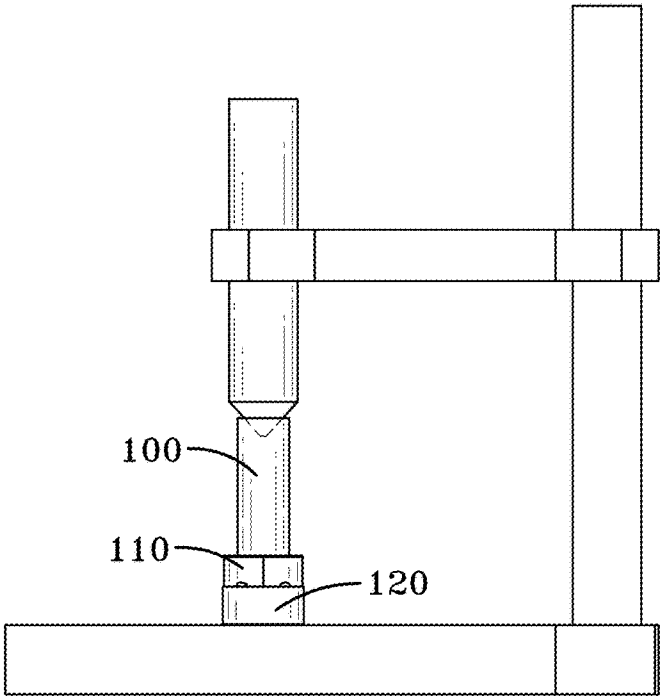
FIG. 33 is a side elevation view of an assembly placed within a press brake.
Figure 36:
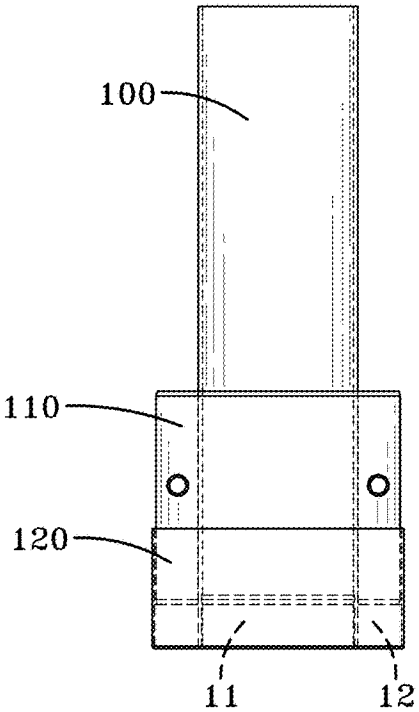
FIG. 36 is a side elevation view of the assembly after diamond particles are placed within the interior of the tube.

After the tube and bushing are engaged within the cup, the assembly is placed within a press brake or similar device. The assembly may be placed on a press base so that a spring loaded press plunger or similar device may be used to apply pressure on the exposed end of the tube, as seen in FIG. 33, wherein the bushing is used to center the tube within the cup while pressure is applied by the press plunger. Once the press plunger contacts and secures the tube against the cup, the bushing may be removed by pulling it up from around the tube and disengaging the two shells from one another, as seen in FIG. 34.

Figure 35:
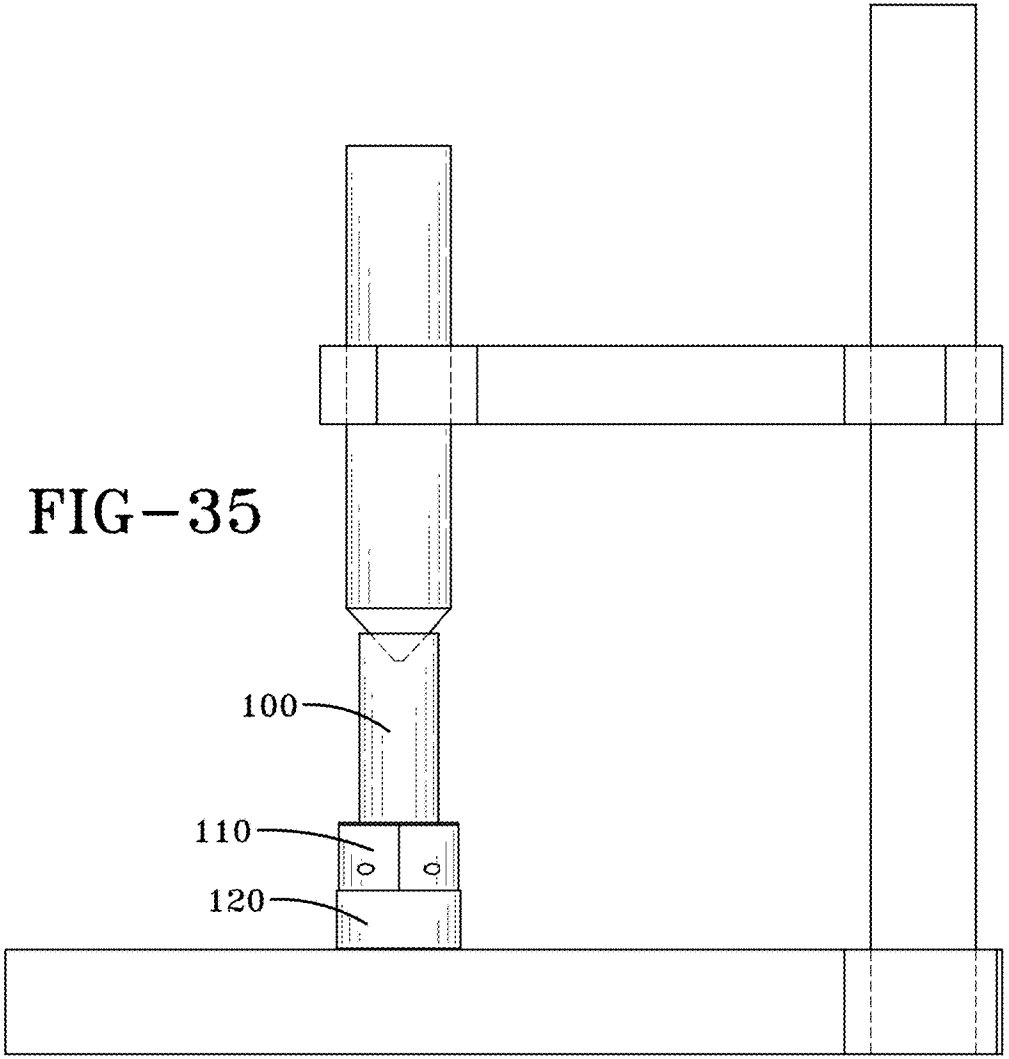
FIG. 35 is a side elevation view of an assembly wherein the bushing is reinserted to level the diamond particles.

After the bushing is removed from the tube and cup, at least a portion of the gap between the exterior wall of the tube and the interior wall of cup may be filled with diamonds. In one example, the gap between the exterior wall of the tube and the interior wall of the cup may be approximately 0.103 inches (2.62 mm) around the periphery of the tube and may be filled with diamonds of a finer size to a height in the gap of approximately 0.10 inches (2.54 mm). The bushing may be used to level the diamond placed within the gap, by reinserting the bushing and pushing against the diamonds located within the cup, as depicted in FIG. 35.

After the diamonds situated in the gap between the exterior wall of the tube and the interior wall of the cup have been leveled, the assembly of the cup, bushing and tube may be removed from the press brake or similar device.

Figure 38:
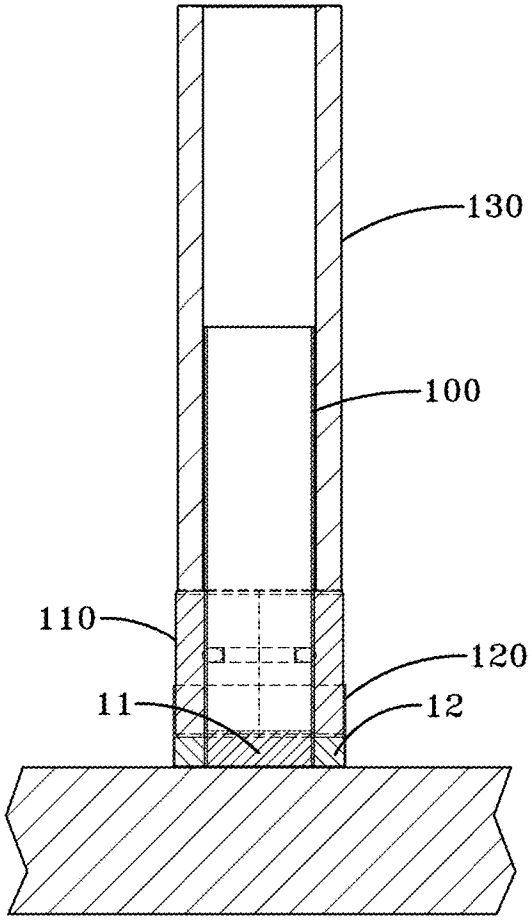
FIG. 38 is a cross-sectional elevation view of an assembly wherein the sleeve is inserted to compact the diamond particles.
Figure 37:
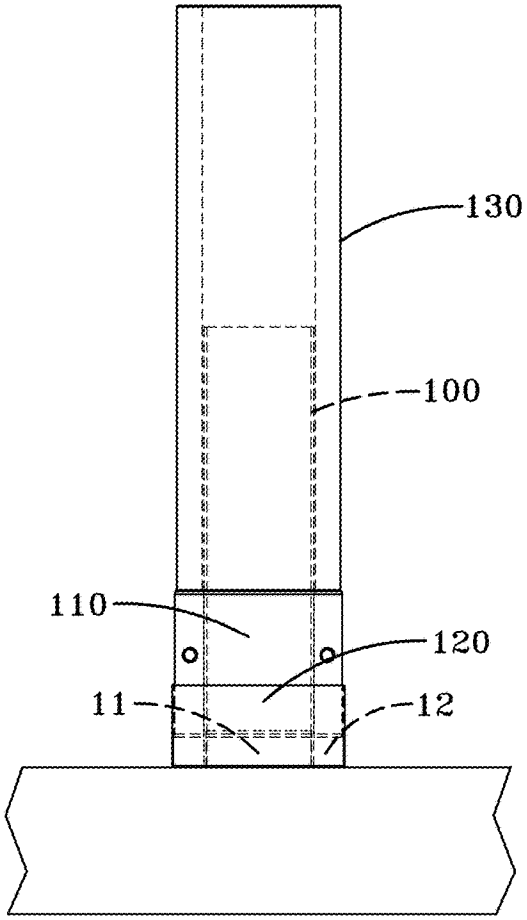
FIG. 37 is a side elevation view of an assembly wherein the sleeve is inserted to compact the diamond particles.

The assembly is then taken to a hydraulic press; a sleeve 130 such as the aforementioned steel tube is slid over the original tube used in the assembly, as depicted in FIGS. 37 and 38. The sleeve 130 may be used to transmit pressure from the ram of a hydraulic press through the bushing and into the fine diamond powder. Once the press is engaged with the sleeve a force is applied. In one example, a 150 lb force applied by the press may generate about 1000 PSI onto the fine diamond powder, which may be enough to compact the diamond and may reduce the presence of voids in the fine diamond crystals body. It must be noted that higher compaction pressures are possible as long as the tube and the cup do not distort due to the applied pressure. A compaction pressure of 2000 PSI was tested. However, in order to protect the cup from deformation, the cup was inserted into a two piece steel cavity that had an inside diameter 0.001" (0.025 mm) larger than the outside diameter of the cup larger. In order to protect the tube from deformation a steel rod with a diameter 0.001" (0.025 mm) smaller than the tube inside diameter, was inserted into the tube. A 300 lb force was applied resulting in 2000 PSI. In exemplary methods, utilizing 1000 PSI seemed to be a practical pressure to apply, as this pressure did not result in significant cup or tube distortion that caused process challenges. After diamond compaction the press ram is disengaged, the sleeve is removed and the assembly is removed from the press or similar device.

Subsequently, diamond particles may be placed within the interior of the tube. In one example, the interior of the tube is filled with diamond particles that are coarser than the diamond particles placed within the gap between the tube and the cup. The coarser diamond particles may be filled within the interior of the tube to any desired height. Although, in one particular example, the interior of the tube is filled to a height of approximately 0.12 inches (3.05 mm). The coarse diamond particles may be leveled by a rod or other device once they are positioned within the tube. The coarse diamond particles may be further compacted using a rod that engages with a hydraulic press or other similar device, the pressure used to compact the coarse diamond is approximately 1000 PSI, in some exemplary embodiments. It must be noted that higher compaction pressures are possible as long as the tube does not distort due to the applied pressure on the rod. Another limitation to the pressure applied is the removal of the tube without distortion of the compacted coarse diamond. When pressure is used on the rod, it may be easier to break the tube loose from the coarse diamond while the rod is still engaged with the press ram or other similar device. In order to provide a desired amount of coarse diamonds to obtain a desired height within the tube, the amount of coarse diamonds may be measured out by weight, volume, etc. prior to positioning the diamond particles within the tube.

After the coarse diamonds have been positioned and leveled within the tube 100, the tube 100 and bushing 110 may be removed from the cup 120. The cup 120 may be filled to a desired height with additional coarse or fine diamonds. Afterwards, the powders in the cup 120 may be put in contact with the substrate body, perhaps vibrated, thermally-cycled and/or hermetically-sealed and then assembled into a standard HPHT pressure cell and sintered at HPHT using well known manufacturing techniques. The resulting hard sintered body comprises a hard diamond table bonded to a substrate. The body is machined to remove cup material and create dimensions and dimensional features, as well as reveal the hard diamond table comprising a perhaps multi-layer, multi-annular volume of PDC of varying grain size and/or varying composition, comprising the diamond table. The machined PDC cutter is then fixed to a tool, such as a drill, and used to cut or drill rock or stone.

Due to the presence of the multiple layers and multiple annular regions within the PDC body of different hardness and/or toughness and/or thermal resistance, the PDC cutter lasts longer than conventional cutters comprising only one single uniform grain size and uniform composition PDC body.

In normal PDC production, diamond powder of one size and one composition is loaded in one mass, leveled and compacted, and then HPHT sintered to form one diamond table. In this novel PDC cutter, diamond powders of different composition and/or different grain size, are distributed, shaped to include novel features and compacted with a novel pressing tool. The diamond powders of different compositions and/or grain size are fabricated in multiple stages, into different volume and shaped regions of the PDC diamond table, then HPHT sintered to form one diamond table with spatially varying hardness, toughness and thermal resistance optimized for the drilling and/or cutting of hard rock and stone.

EXAMPLES

A number of samples with different diamond configurations were prepared and evaluated for impact and abrasion resistance. The impact and abrasion resistance tests performed on these samples are standard tests in the PDC industry.

Description of Impact Test: This test evaluates the resistance of the PDC cutter to damage due to being struck by a solid object with a specific amount of energy. The impact test was performed by dropping a certain mass from specific height to produce 20 joules on energy on the impacted PDC. The PCD edge which was held at a 15° angle. Each time the mass is dropped on the PDC cutter, the cutter is examined visually and the area damaged (the area of the top surface of the PDC) after each hit is recorded, if the area damaged exceeds 25% of the total surface, the test is stopped, otherwise, the test is repeated 10 times. The total area damaged after the final hit (that would be the $10^{th}$ hit if the PDC cutter does not exceed 25% area damage after any hit) is calculated and recorded as a percent of the total area of the top diamond surface. Then the average damage per drop is calculated by dividing the percentage of the area damaged divided by the number of hits performed on the PDC. This test is performed on a number of PDC cutters at least 10 pcs are tested and the average damage per hit for all pieces is reported. The measurement is reported as "percent average damage per hit" a lower value for average damage per hit is an indication of a better impact resistance cutter. In addition to the average damage per hit the average number of hits is reported, the higher the number of hits the better the cutter is on impact resistance.

Description of Abrasion Test: The abrasion test evaluates the resistance of the PDC cutter to abrasion against a specific material, in this case Granite. The abrasion test consists of using the PDC cutter to machine a block of granite mounted on a vertical turning lathe. The PDC is used as the cutting tool to machine the granite block. Machining is done wet (water is flushed onto the PDC as it is engaged in the cutting action). The PDC cutter evaluated for abrasion resistance will be used to make 7 cuts of equal depth on the granite. At the end of the test, the cutter is examined and the volume of PDC that wore off is calculated, the volume of granite that was machined off using the PDC cutter is also calculated, if the wear of the PDC is too large or if the PDC part exhibits excessive breakdown, the test is stopped before all seven cuts are finished. The ratio between the Volume of Granite machined divided by the volume of the PDC machined is the G-ratio and is a measure of the abrasion resistance of the PDC cutter.

Example #1

Figure 39A:
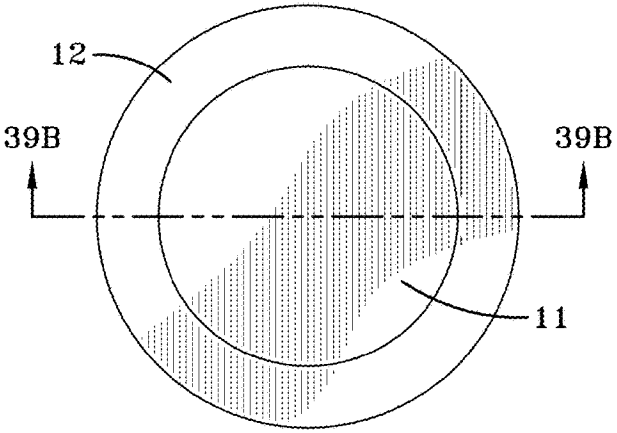
FIG. 39A is a top plan view of an exemplary PDC body.
Figure 39B:
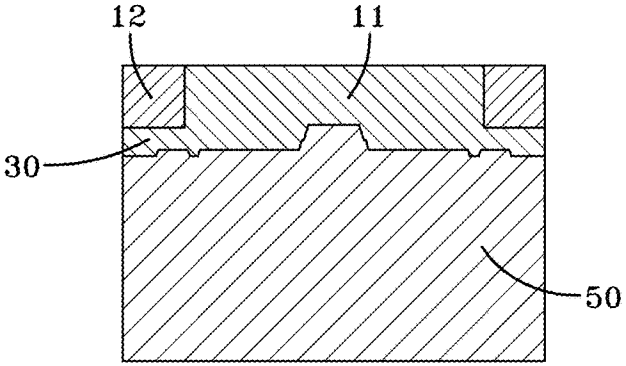
FIG. 39B is a cross-sectional side elevation view of an exemplary PDC body.
Figure 40A:
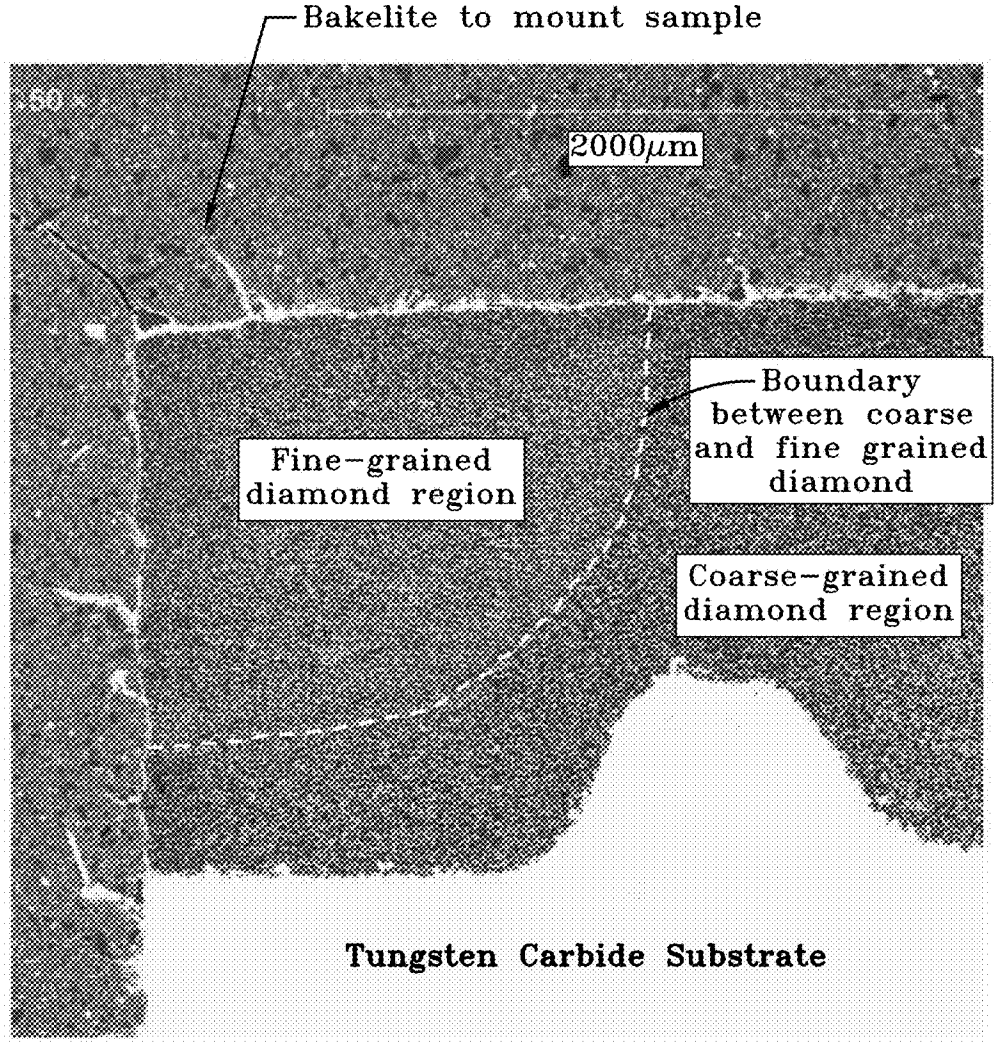
FIG. 40A is an SEM picture taken of the cross section of an exemplary PDC body.

In this example the design of the PCD layer was made with two components, a fine-grained diamond ring surrounding a coarse-grained diamond core as shown in FIG. 39*a*. The fine-grained diamond powder was compacted using 1000 PSI pressure. The coarse-grained diamond powder was leveled with a rod and compacted by hand; no device was used to apply extra pressure on the coarse grained diamond. When the diamond powder compaction was done the cross section of the coarse/fine diamond interface was rectangular, a straight vertical line and a straight horizontal line separated the diamond layers. There is no curvature or taper at the interface, and no corner radii. The product was processed under high pressure in excess of 55 kbar and temperature about 1500° C., The parts were afterwards machined to final dimensions, outside diameter of 0.529" (13.44 mm) and a total height of 0.520" (13.44 mm). FIG. 39*b* depicts the designed PCD layer with fine-grained diamond at the edge. FIG. 40*a* is an SEM picture taken of the cross section of the PDC part mentioned above, after it has been processed in HPHT and finished. It is noted that after processing in HPHT, the interface between the two diamond layers acquired some taper and a corner radius, this deformation may have occurred due to diamond powder shifting under high pressure.

Example #2

Figure 39C:
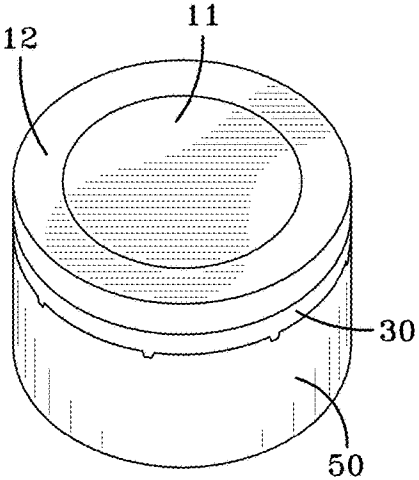
FIG. 39C is a perspective view of an exemplary PDC body.
Figure 40B:
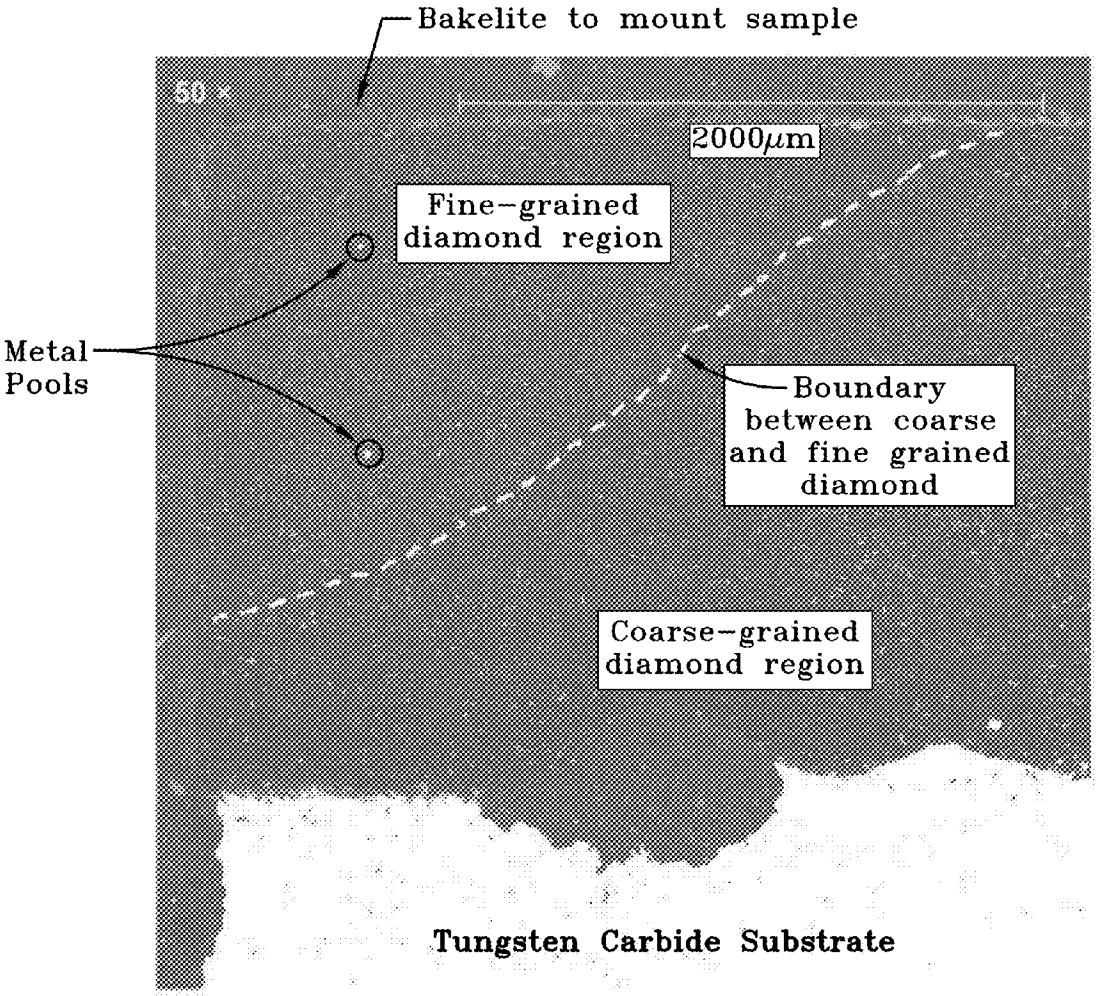
FIG. 40B is an SEM picture taken of the cross section of an exemplary PDC body.

This example is similar to example #1, the design of the PCD layer was made with two components, a fine-grained diamond ring surrounding a coarse-grained diamond core as shown in FIG. 39*c*. However, the fine-grained diamond was not compacted; the coarse-grained diamond was leveled with a rod without any compaction. The cross section of the fine-grained diamond ring is a rectangle. Similar to the first example, when the diamond powder was loaded in the cup the cross section of the coarse/fine diamond interface was rectangular, a straight vertical line and a straight horizontal line separated the diamond layers. There is no curvature or taper at the interface, and no corner radii. The product was processed under high pressure and finished as the previous example. FIG. 40*b* is an SEM picture taken of the cross section of the PDC part mentioned above, after it has been processed in HPHT and finished.

Figure 40C:
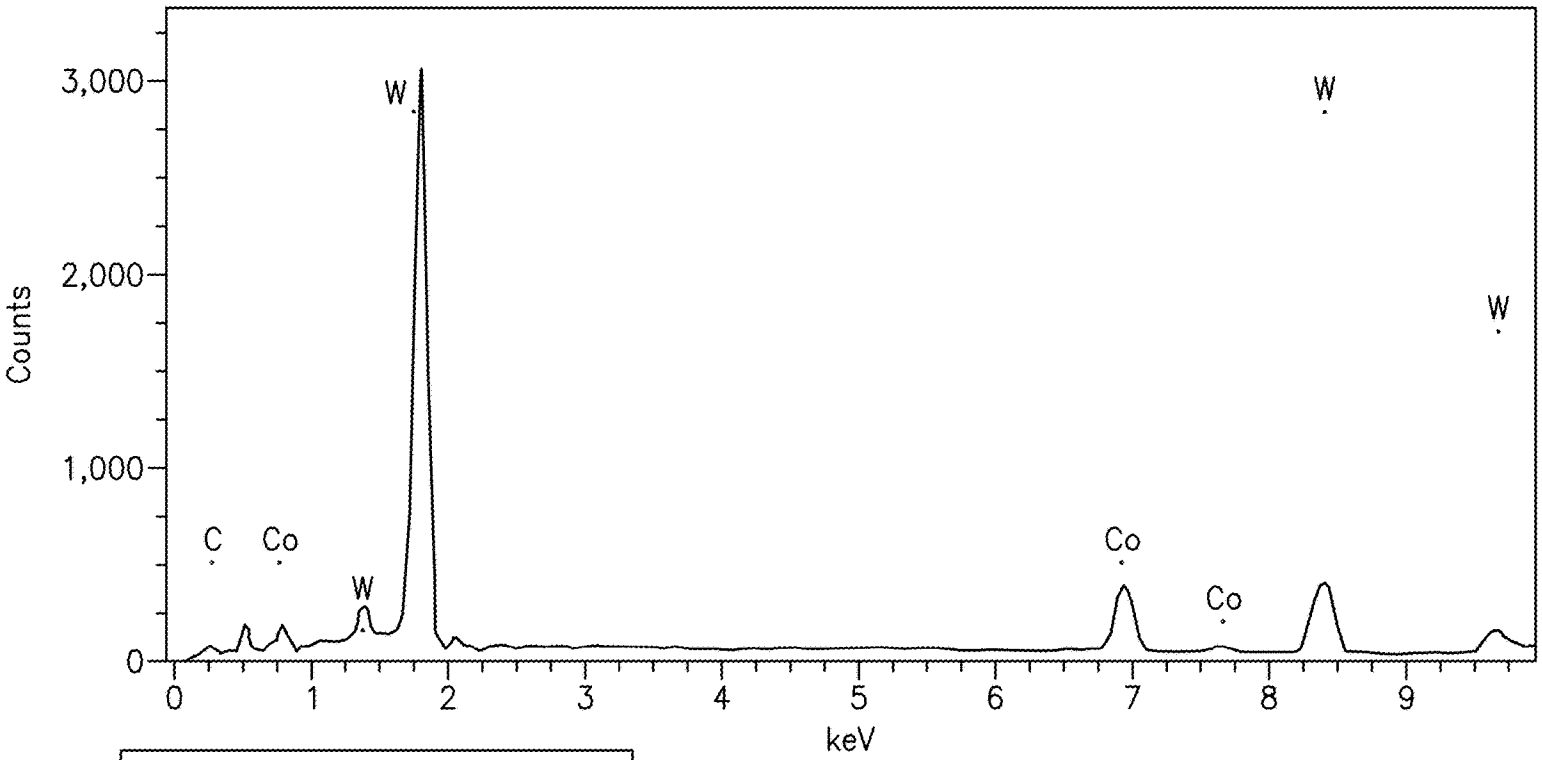
FIG. 40C is an elemental analysis (Energy Dispersive X-ray Spectroscopy or EDS) of an exemplary PDC body.

It is noted that after processing in HPHT, the interface between the two diamond layers was significantly changed. The diamond powders have shifted more than they did when the powders was compacted, the interface looks almost like a straight line. In addition to the interface boundary changing in shape, small metal pools are evident in the fine-grained diamond body; these appear as white spots and are circled as illustrated in FIG. 40*b*. Upon using elemental analysis (Energy Dispersive X-ray Spectroscopy or EDS FIG. 40*c*), the metal pools appear to be composed of Tungsten (83%) and Cobalt (17%). The occurrence of these metal pools may have been a result of loose packing of the fine-grained diamond.

Example #3

Figure 41A:
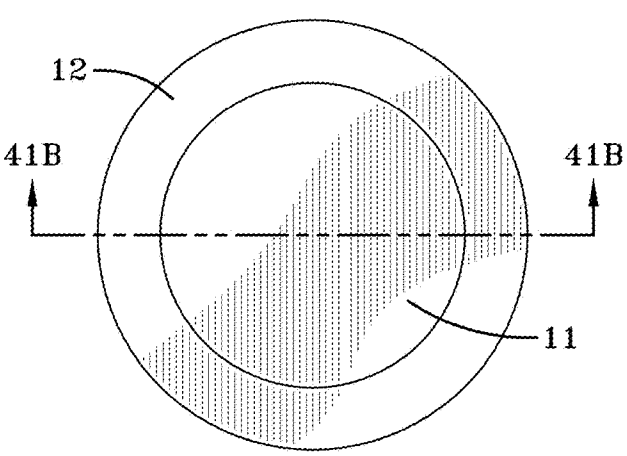
FIG. 41A is a top plan view of an exemplary PDC body.
Figure 41B:
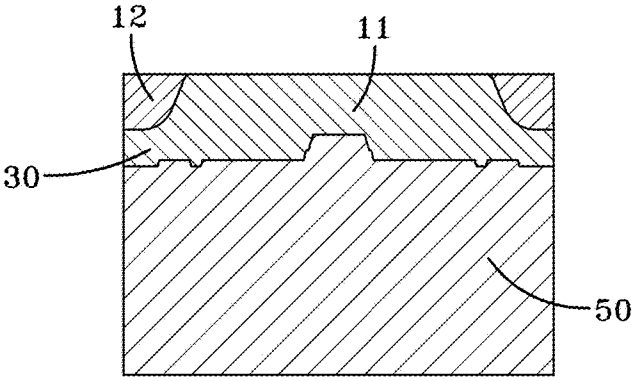
FIG. 41B is a cross-sectional side elevation view of an exemplary PDC body.
Figure 41C:
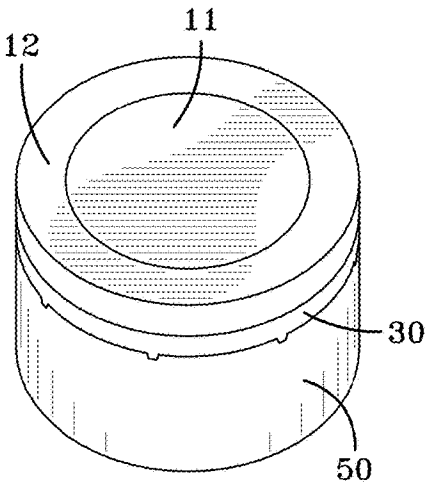
FIG. 41C is a perspective view of an exemplary PDC body.
Figure 42:
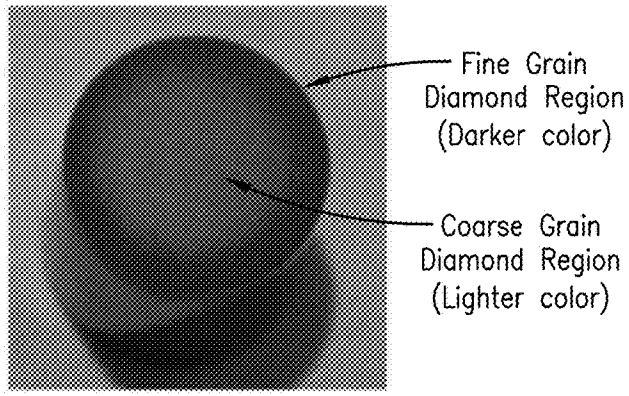
FIG. 42 is a perspective view of an exemplary PDC body.
Figure 43:
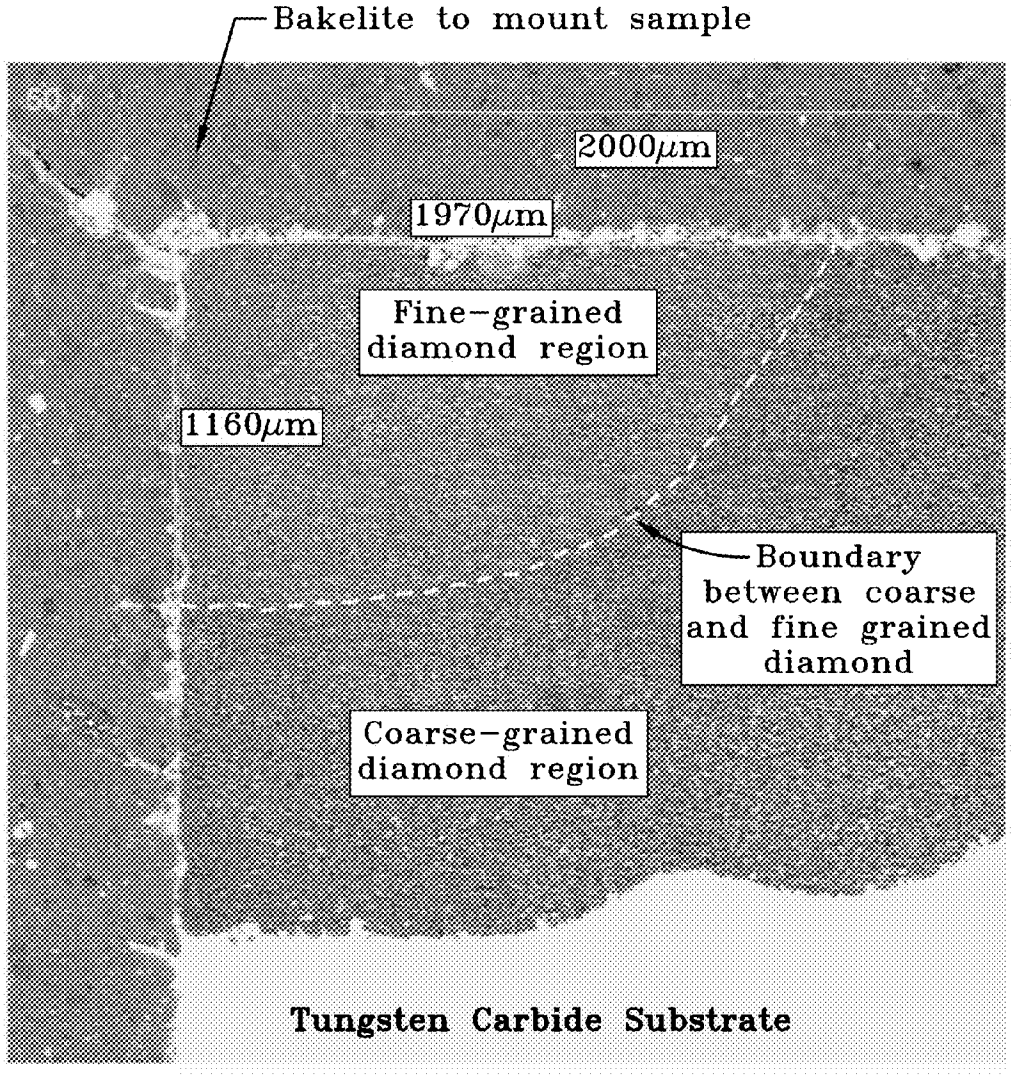
FIG. 43 is an SEM picture taken of the cross section of an exemplary PDC body.

In this example the fine-grained diamond powder ring has a cross section that is tapered (the cross section width of the fine diamond increases as it gets closer to the diamond face), The cross section also has a corner radius. The fine-grained diamond was compacted using 1000 PSI pressure, the coarse-grained diamond was leveled with a rod and compacted by hand, no device was used to apply extra pressure. This part was processed in HPHT and finished as the previous example. FIGS. 41*a* and 41*b* show a cross section of the designed PCD layer, FIG. 41*c* is a model of the designed PDC part. FIG. 42 is a picture of the actual part. FIG. 43 is an SEM picture taken of the cross section of the PDC part mentioned above, after it has been processed in HPHT and finished.

It is noted that after processing in HPHT, the interface between the two diamond layers acquired more taper and the corner radius grew, the whole interface line boundary appears like a curved line. This deformation may have occurred due to diamond powder shifting under high pressure.

Example 4

Figure 44A:
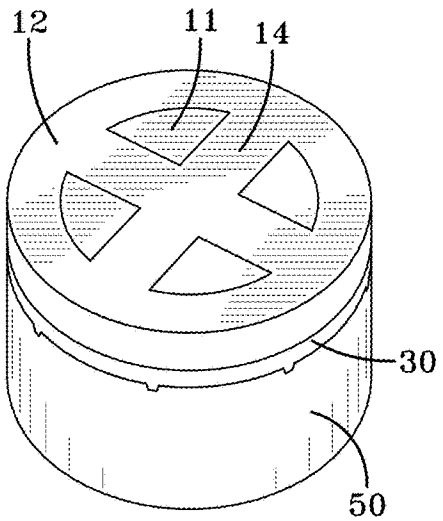
FIG. 44A is a perspective view of an exemplary PDC body.
Figure 45:
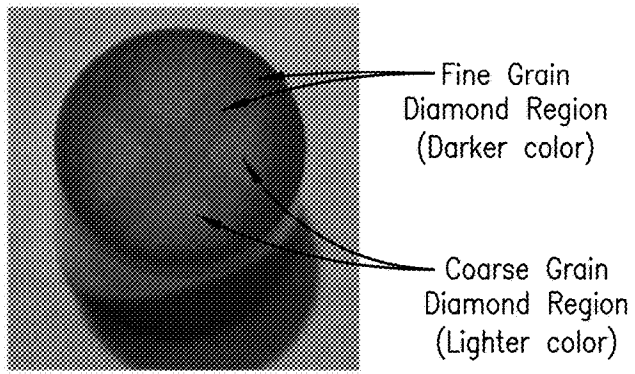
FIG. 45 is a perspective view of an exemplary PDC body.
Figure 44B:
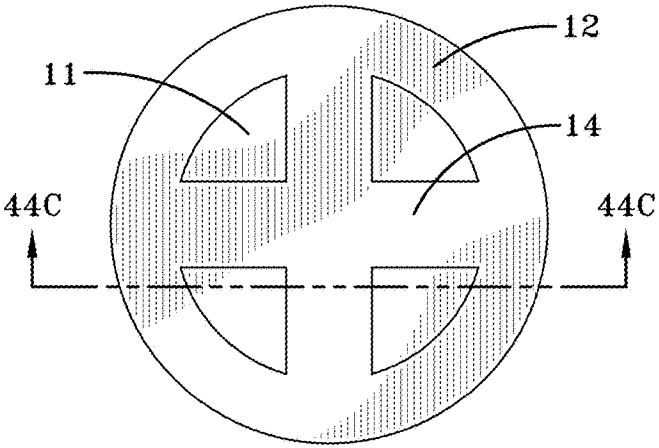
FIG. 44B is a top plan view of an exemplary PDC body.
Figure 44C:
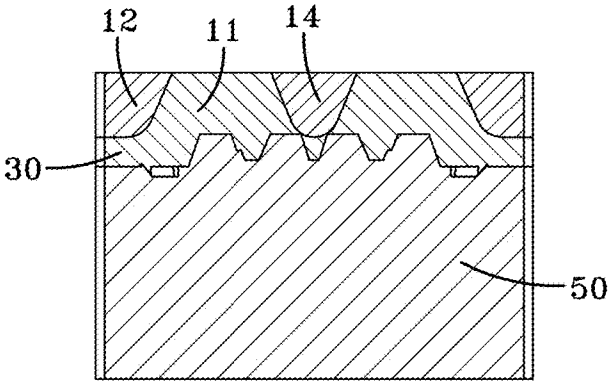
FIG. 44C is a cross-sectional side elevation view of an exemplary PDC body.
Figure 46:
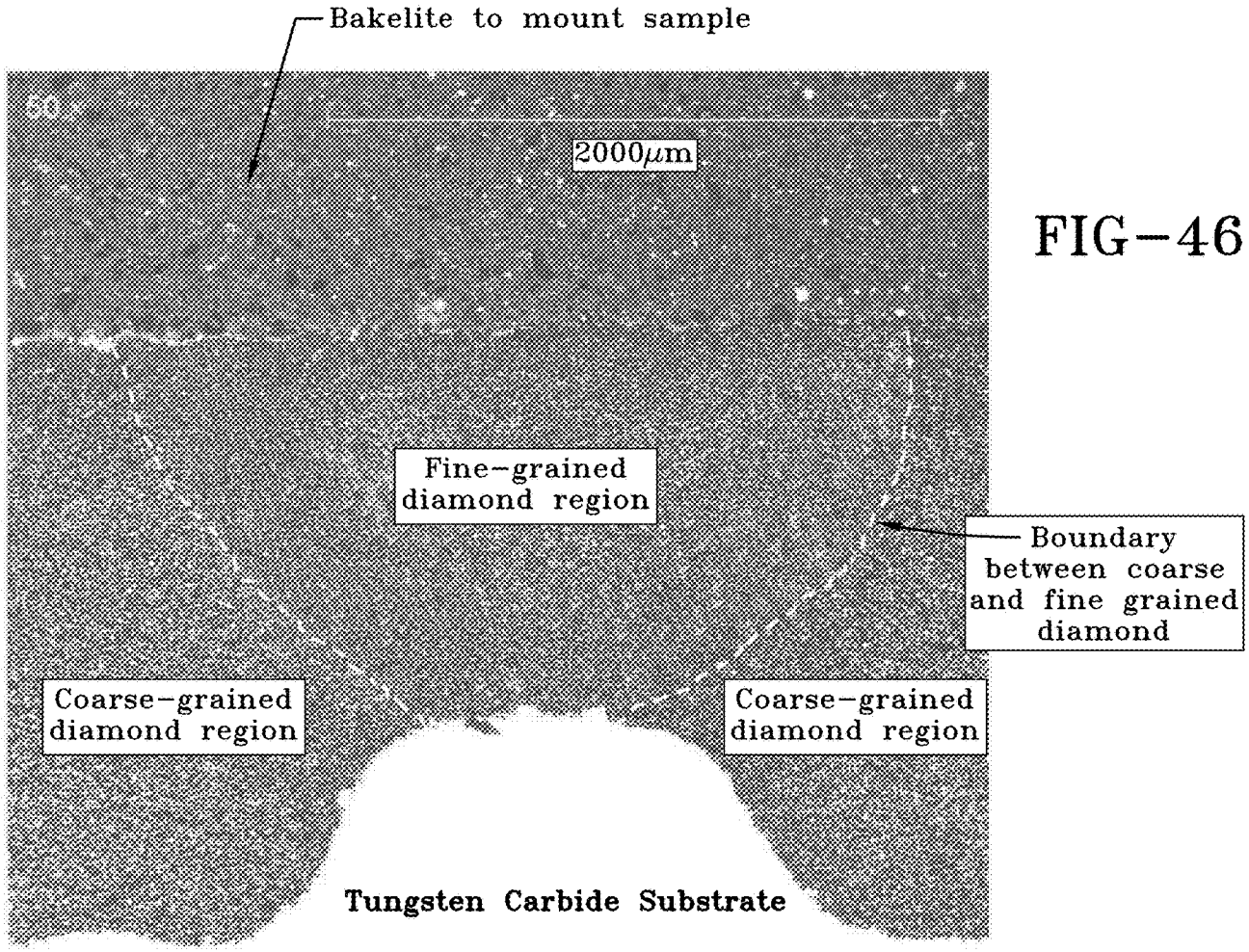
FIG. 46 is an SEM picture taken of the cross section of an exemplary PDC body.

Following on examples 1 and 2 a cross shaped groove filled with fine-grained diamond. This groove is compacted with fine-grained diamond of the same type of diamond used in the ring. The fine-grained diamond was compacted using 1000 PSI pressure, the coarse-grained diamond was leveled with a rod and compacted by hand, no device was used to apply extra pressure. The geometry of the groove is tapered and has a radius at the bottom of the groove. FIG. 44*a* shows the designed diamond arrangement in the ring and the cross. FIGS. 44*b* and 44*c* show a cross section of the designed PCD layer. FIG. 45 is a picture of the actual part made using the concept discussed above. FIG. 46 is an SEM picture taken of the cross section of the PDC part mentioned above, after it has been processed in HPHT and finished as the previous example.

It is noted that after processing in HPHT, the interface between the two diamond layers acquired more taper and the corner radius grew, the whole interface line boundary appears like a curved line. This deformation may have occurred due to diamond powder shifting under high pressure.

Example 5

When the coarse-grain to fine-grain diamond size ratio exceeds 1½ times, sintering of the fine-grain diamond is adversely affected, most of the molten Cobalt sweeps through the Coarse-grained diamond and a small amount sweeps through the fine-grained diamond, this condition may result in poorly sintered fine-grained PCD. When such a condition occurs, the addition of Cobalt powder that is blended with the fine-grain diamond powder may help the Cobalt sweep through the fine-grain diamond powder. Addition of Cobalt powder to the fine-grain diamond powder is done at a mix ratio of 2-5% (higher blend ratios reduce the abrasion resistance of the sintered fine-grained diamond). The particle size of Cobalt powder used is 1 micron. Such blending is followed by reduction of the diamond powder Cobalt blend in a Hydrogen rich environment done in a furnace at 850-1050° C. for a duration of 1-3 hours (depends on the firing temperature). This process is done to ensure the reduction of any Cobalt Oxides prior to sintering the diamond powder Cobalt blend. A PDC product was made using the Cobalt blended diamond crystals in the fine-grain diamond powder the fine-grain diamond size was 4 micron, the coarse-grain diamond size was 12 micron. A part similar to example 3 was made using the Cobalt blended fine-grained diamond. Diamond powders were loaded in the cup, compaction of both the fine-grain diamond powder and the coarse-grained diamond powder was done at 1000 PSI. This part was processed in HPHT and finished as the previous examples. The fine-grained diamond sintered well; there was no evidence of cracks or chips in neither the fine-grain nor the coarse-grain diamond layers.

Figure 47:
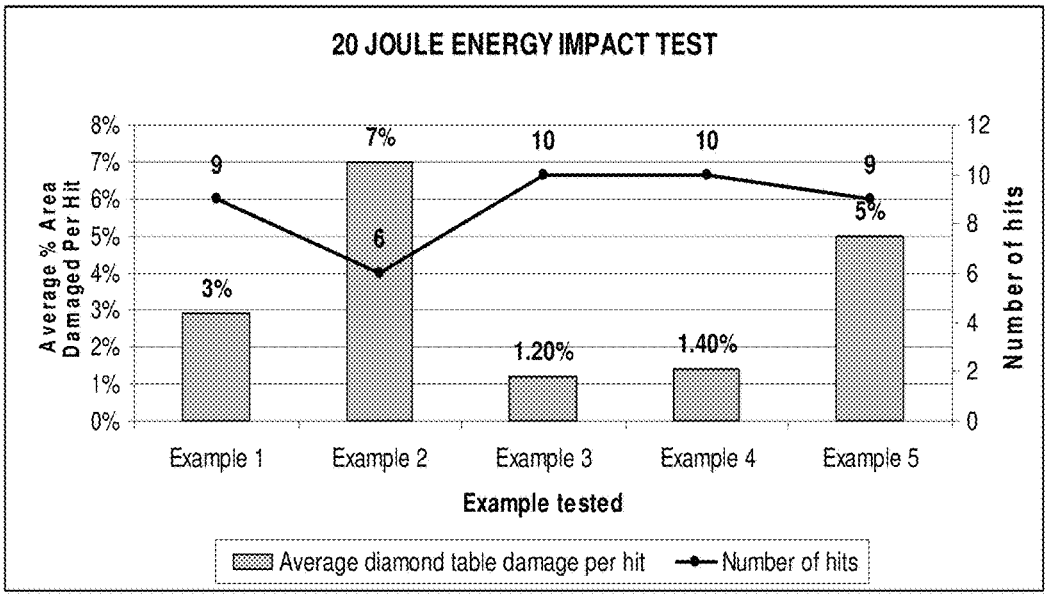
FIG. 47 is a table showing the impact test results.
Figure 48:
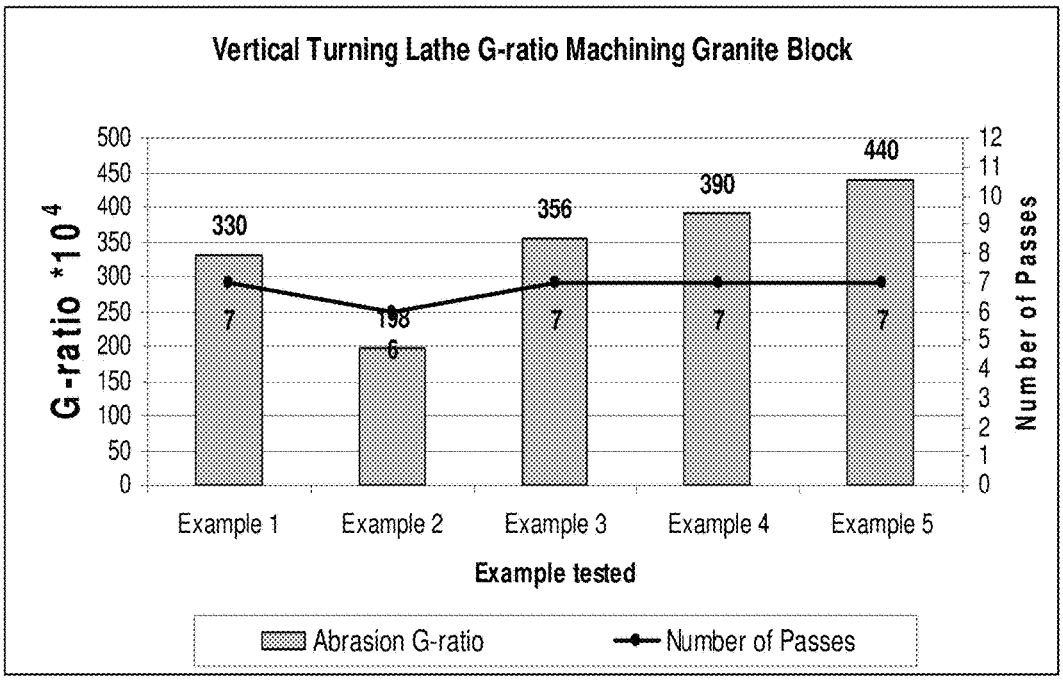
FIG. 48 is a table summarizing the abrasion test results.

Impact and abrasion testing and test result summary: The finished product was then tested for impact and abrasion resistance per the tests described above, 10 pieces of each example were tested for impact and two pieces of each example were tested for abrasion resistance and the average was calculated and reported. FIG. 47 summarizes the impact test results of the products tested (samples 1 through 5). FIG. 48 summarizes the abrasion test results of the abrasion tests performed on the products tested.

Test Summary

Example 1

This example had neither taper nor a corner radius in the interface cross section. This product showed low impact resistance when compared to examples 3 and 4 (which were made using the same diamond grains sizes). The abrasion resistance of this example was slightly lower than that of examples 3 and 4.

Example 2

This Example had neither taper nor a corner radius in the interface cross section, and the fine-grained diamond was not compacted. The Impact resistance of this product was lower than all the examples tested; the abrasion resistance was the lowest too. Also, the fine-grained diamond layer exhibited an abundance of metal pooling.

Example 3

This Example had a taper and a corner radius on the fine diamond cross section. This example performed the best on impact resistance and had high abrasion resistance higher than examples 1 and 2 but slightly less than example 3, however, its abrasion resistance was lower than example 5 (example 5 was made with a different diamond grain in the ring layer, the fine grain diamond in the ring was the finest used amongst the examples).

Example 4

This Example was similar to example 3 with the addition of a cross shaped region that crosses the diamond surface and is made up of fine-grained diamond crystals similar to the diamond present in the ring. The impact resistance of this example was similar to example 3 and the abrasion was slightly higher than example 3 but was less than example 5 for the same reason mentioned in example 3.

Example 5

This Example was prepared similar to example 3, the main difference is that a finer diamond grain was used and it was blended with Cobalt powder at a 2% ratio, the coarse diamond used was 3 times coarser than the fine-grained diamond. This example showed the highest abrasion resistance since it used a finer diamond grain in the ring geometry than the rest of the examples. Its impact resistance was less than example 3 and 4 due to the same reason mentioned above that is finer grain diamond was used in this example, in both the ring layer and the rest of the diamond body.

While certain exemplary embodiments are described in detail above for purposes of illustration, it would be apparent to one of skill in the art that changes may be made thereto without departing from the scope of the present invention. Therefore, the scope of the invention is not to be considered limited by such disclosure, and modifications are possible without departing from the spirit of the invention as evidenced by the following claims:

What is claimed is:

1. A method for forming a cutting tool, comprising the steps of:

providing a portion of each of at least a first and a second diamond powder, the respective first and second diamond powders differing from each other in at least one of: grain size and composition;

forming a polycrystalline diamond composite ("PDC") body comprising at least two shaped discrete volumes, each of the shaped discrete volumes consisting essentially of only one of the respective first and second diamond powders, comprising the substeps of:

arranging, in a cup with a closed end and an open end, at least one shaped discrete volume of the first diamond powder, comprising the steps of:

inserting a tube into the cup;

centering the tube in the cup, effectively dividing the cup into an interior of the tube and an annulus between the cup and an exterior of the tube;

placing the first diamond powder in the annulus; and shaping the first diamond powder into at least one shaped discrete volume;

compacting the at least one shaped discrete volume of the first diamond powder;

arranging, in the cup, at least one shaped discrete volume of the second diamond powder, in contact with the at least one shaped discrete volume of the first diamond powder; and compacting all of the shaped discrete volumes of the respective diamond powders, resulting in the formed PDC body;

placing a substrate into intimate contact with the formed PDC body; and sintering, under high pressure and high temperature (HPHT) conditions, the substrate to the formed PDC body.

2. The method of claim 1, wherein: the respective diamond powders differ in that the second diamond powder is coarser than the first diamond powder.

3. The method of claim 1, wherein: each compacting step is achieved by applying a pressure of at least 1000 psi to the shaped discrete volumes.

4. The method of claim 1, wherein: the step of compacting the at least one shaped discrete volume of the first diamond powder is achieved by:

inserting a bushing into the annulus around the tube and onto the at least one shaped discrete volume of first diamond powder;

applying, through the bushing, a compacting pressure of at least about 1000 psi onto the at least one shaped discrete volume.

5. The method of claim 4, wherein: the step of arranging the at least one shaped discrete volume of the second diamond powder is achieved by:

filling the second diamond powder into the interior of the tube;

applying, through a rod placed into the tube, a compacting pressure of at least about 1000 psi onto the second diamond powder;

removing the tube from the cup; and adding into the cup an additional volume of at least one of the first and second diamond powders.

* * * * *